US007346295B2

(12) United States Patent
Mochimaru

(10) Patent No.: US 7,346,295 B2
(45) Date of Patent: Mar. 18, 2008

(54) BELT MEMBER AND BELT DEVICE USING THE SAME

(75) Inventor: Hideaki Mochimaru, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 238 days.

(21) Appl. No.: 11/036,024

(22) Filed: Jan. 18, 2005

(65) Prior Publication Data

US 2005/0185988 A1 Aug. 25, 2005

(30) Foreign Application Priority Data

Jan. 19, 2004 (JP) ..... 2004-010377

(51) Int. Cl.
*G03G 15/00* (2006.01)

(52) U.S. Cl. ..... 399/165; 399/303; 399/312

(58) Field of Classification Search ..... 399/162, 399/312, 303, 165, 329, 302, 309; 198/837, 198/840

See application file for complete search history.

(56) References Cited

U.S. PATENT DOCUMENTS

| | | | | |
|---|---|---|---|---|
| 3,186,536 | A * | 6/1965 | Hinchcliffe | 198/840 |
| 4,225,036 | A * | 9/1980 | Michael | 198/840 |
| 5,758,245 | A * | 5/1998 | Matsuura et al. | 399/329 |
| 5,953,572 | A * | 9/1999 | Takeuchi et al. | 399/302 |
| 6,097,922 | A * | 8/2000 | Munenaka | 399/312 |
| 6,597,887 | B2 * | 7/2003 | Sakai et al. | 399/309 |
| 6,633,733 | B2 * | 10/2003 | Mochimaru et al. | 399/302 |
| 6,871,038 | B2 * | 3/2005 | Fujiwara | 399/303 |
| 7,020,431 | B2 * | 3/2006 | Sahara | |

FOREIGN PATENT DOCUMENTS

| | | | |
|---|---|---|---|
| EP | 1 202 131 | A2 | 5/2002 |
| JP | 60050567 | A * | 3/1985 |
| JP | 60151678 | A * | 8/1985 |
| JP | 10-268660 | | 10/1998 |
| JP | 11002980 | A * | 1/1999 |
| JP | 11185933 | A * | 7/1999 |
| JP | 3218330 | | 8/2001 |
| JP | 2003076206 | A * | 3/2003 |
| JP | 2003-177617 | | 6/2003 |

OTHER PUBLICATIONS

Patent Abstracts of Japan, JP 05-294494, Nov. 9, 1993.

(Continued)

*Primary Examiner*—Susan Lee
(74) *Attorney, Agent, or Firm*—Oblon, Spivak, McClelland, Maier & Neustadt, P.C.

(57) ABSTRACT

A belt member of the present invention includes ribs that prevent the belt member from being shifted to either side. A plurality of cuts are formed in each rib at preselected intervals in the circumferential direction of the belt member, and each extends from the top toward the bottom of the rib. The cuts may be replaced with projections and recesses alternating with each other in the cicumferential direction of the belt member or bores formed at preselected intervals in the above direction. Such ribs allow, without being subject to a heavy load, the belt member to be wrapped around a support roller with a large curvature or bent in the inverse direction. This reduces deterioration and slippage ascribable to the position of the belt member desirable for the size reduction of an apparatus on which the belt member is mounted.

46 Claims, 13 Drawing Sheets

OTHER PUBLICATIONS

Patent Abstracts of Japan, JP 59-111182, Jun. 27, 1984.
Patent Abstracts of Japan, JP 2003-040410, Feb. 13, 2003.
Patent Abstracts of Japan, JP 2000-095378, Apr. 4, 2000.
Patent Abstracts of Japan, JP 2001-282017, Oct. 12, 2001.
Patent Abstracts of Japan, JP 09-230745, Sep. 5, 1997.
Patent Abstracts of Japan, JP 2003-316099, Nov. 6, 2003.

* cited by examiner

BELT MEMBER AND BELT DEVICE USING THE SAME

BACKGROUND OF THE INVENTION

1. Field of the Invention

The present invention relates to a fixing belt, sheet conveying belt, intermediate image transferring belt or similar belt member included in an image forming apparatus and a belt device, a sheet conveying device, a fixing device, an image transferring device, a duplex image transferring device and an image forming apparatus using the same.

2. Description of the Background Art

It is a common practice with an image forming apparatus to use a belt device in which an endless belt for, e.g., conveying a sheet or effecting intermediate transfer of a toner image formed on a photoconductive drum or similar image carrier is passed over a plurality of support rollers. One of the support rollers is implemented as a drive roller for driving the belt. A problem with such a belt device is that it is difficult to position the support rollers precisely horizontally or make the circumferential length of the belt member uniform in the widthwise direction thereof, resulting in the deviation of the belt member to one side in the axial direction of the support roller during the drive of the belt member.

In light of the above, Japanese Patent Laid-Open Publication No. 4-190280, for example, discloses an image forming apparatus including a belt member formed with circumferential ribs that adjoin opposite edges of the inside surface of the belt member. The ribs are configured to abut against the ends of a support roller to thereby prevent the belt member from being shifted and running off the support roller.

Japanese Patent Laid-Open Publication No. 10-268660, for example, teaches an image forming apparatus in which ribs, formed on the inside surface of a belt member, are received in annular grooves formed in a support roller in order to prevent the belt member from running off the support roller.

Today, the diameter of a support roller is deceasing to meet the increasing demand for the size reduction of an image forming apparatus. As a result, a belt member is often wrapped around a support roller with a large curvature 1/R, which is the reciprocal of a diameter. Further, a belt member sometimes must be pressed from the outside to be inversely bent toward the inside for the purpose of enhancing free layout around the belt member, as in an image forming apparatus proposed by Japanese Patent Laid-Open Publication No. 2003-177617.

However, if a belt member is wrapped around a support roller with a large curvature or inversely bent inward, then ribs formed on the belt member for the anti-deviation purpose are subject to a heavy load and easily cracked or otherwise deteriorated. Moreover, the ribs, thicker than the base of the belt member and difficult to bend, prevent the base from smoothly bending or inversely bending and thereby cause it to locally rise away from and therefore slip on the support roller.

SUMMARY OF THE INVENTION

It is an object of the present invention to provide a belt member free from deterioration and slippage even when wrapped around a support roller with a large curvature, inversely bent or otherwise held in a position desirable for the size reduction of an image forming apparatus and a belt device, a sheet conveying device, a fixing device, an image transferring device, a duplex image transferring device and an image forming apparatus using the same.

In accordance with the present invention, a belt member includes an endless inside surface formed with a rib extending in the circumferential direction of the belt member for protecting it from deviation. A plurality of cuts are formed in the rib at intervals in the circumferential direction, and each extends from the top toward the bottom of the rib.

Also, in accordance with the present invention, a belt member includes an endless inside surface formed with a rib extending in the circumferential direction of the belt member for protecting it from deviation. A plurality of irregularities, consisting of projections and recesses alternating with each other, are formed in the rib at intervals in the circumferential direction.

Further, in accordance with the present invention, a belt member includes an endless inside surface formed with a rib extending in the circumferential direction of the belt member for protecting it from deviation. A plurality of bores are formed in the rib at intervals in the circumferential direction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
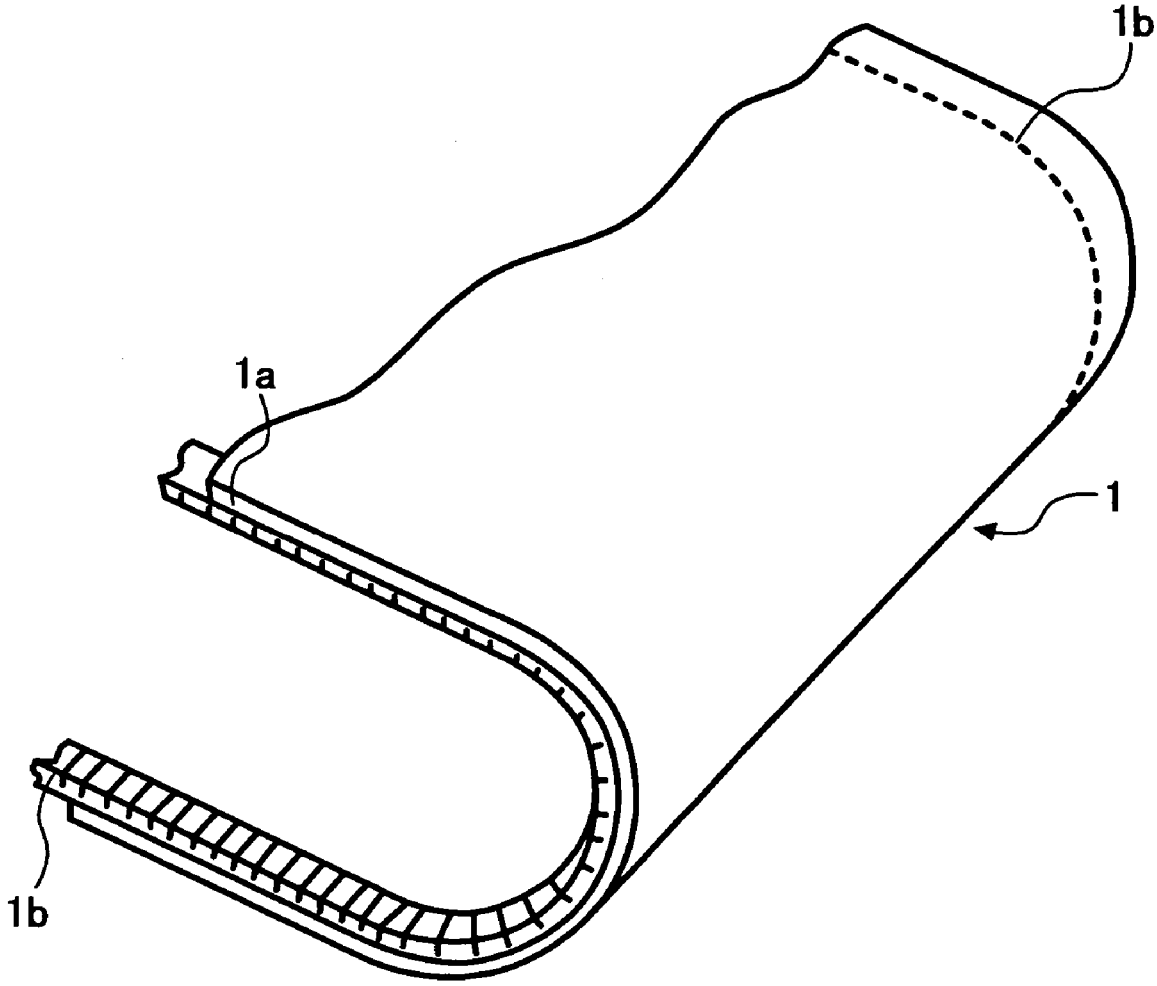
FIG. 1 is a fragmentary perspective view showing a first embodiment of the belt member in accordance with the present invention.

Referring to FIG. 1 of the drawings, a first embodiment of the belt member in accordance with the present invention is shown. As shown, the belt member, generally 1, is made up of an endless base 1*a* and ribs 1*b* protruding from the inside or inner surface of the base 1*a*, i.e., the inner surface of a loop over the entire circumference of the belt member. The ribs 1*b*, adjoining opposite edges of the base 1*a* in the widthwise direction of the belt member 1, prevent the belt member 1 from being deviated, or shifted, to one side on a roller, not shown, supporting it.

Figure 2:
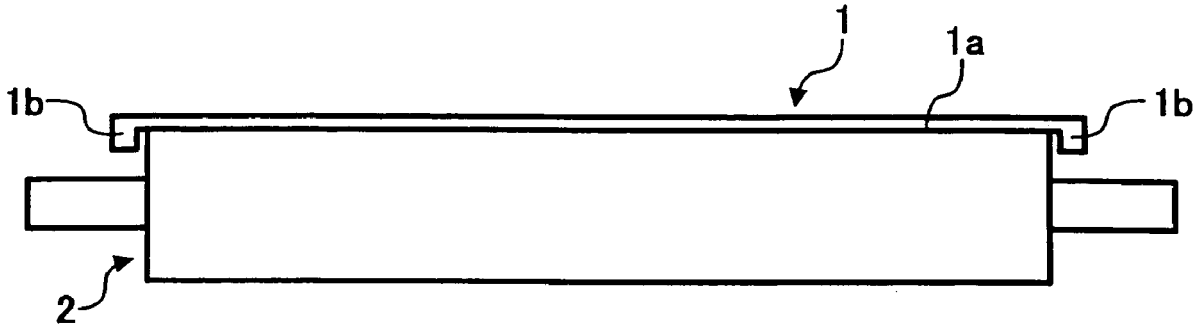
FIG. 2 is a front view showing a support roller supporting the belt member of FIG. 1.

More specifically, while the belt member 1 is expected to run straight between a plurality of rollers, it is, in practice, slightly deviated to one side in the widthwise direction. If the belt member 1 continuously runs in the deviated position, then it runs off the rollers in due course. The ribs 1*b* prevent the belt member 1 from running off the rollers, as shown in FIG. 2 specifically. As shown, when the belt member 1 is deviated to the right by way of example, the rib 1*b* positioned at the left edge of the base 1*a* abuts against the left end of a roller 2 over which the belt member 1 is passed, preventing the belt member 1 from being deviated any further. This is also true when the belt member 1 is deviated to the left in FIG. 2.

Figure 3:
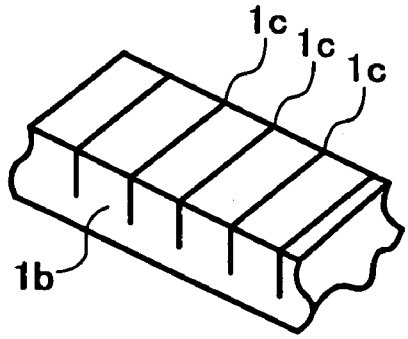
FIG. 3 is a fragmentary isometric view showing a rib formed on the belt member of FIG. 1 in an enlarged scale.

FIG. 3 shows one of the ribs 1*b* in a fragmentary isometric view. As shown, a plurality of cuts 1*c* are formed in the rib 1*b* at preselected intervals in the circumferential direction of the belt member 1, and each extends from the top toward the bottom of the rib 1*b*.

Figure 4:
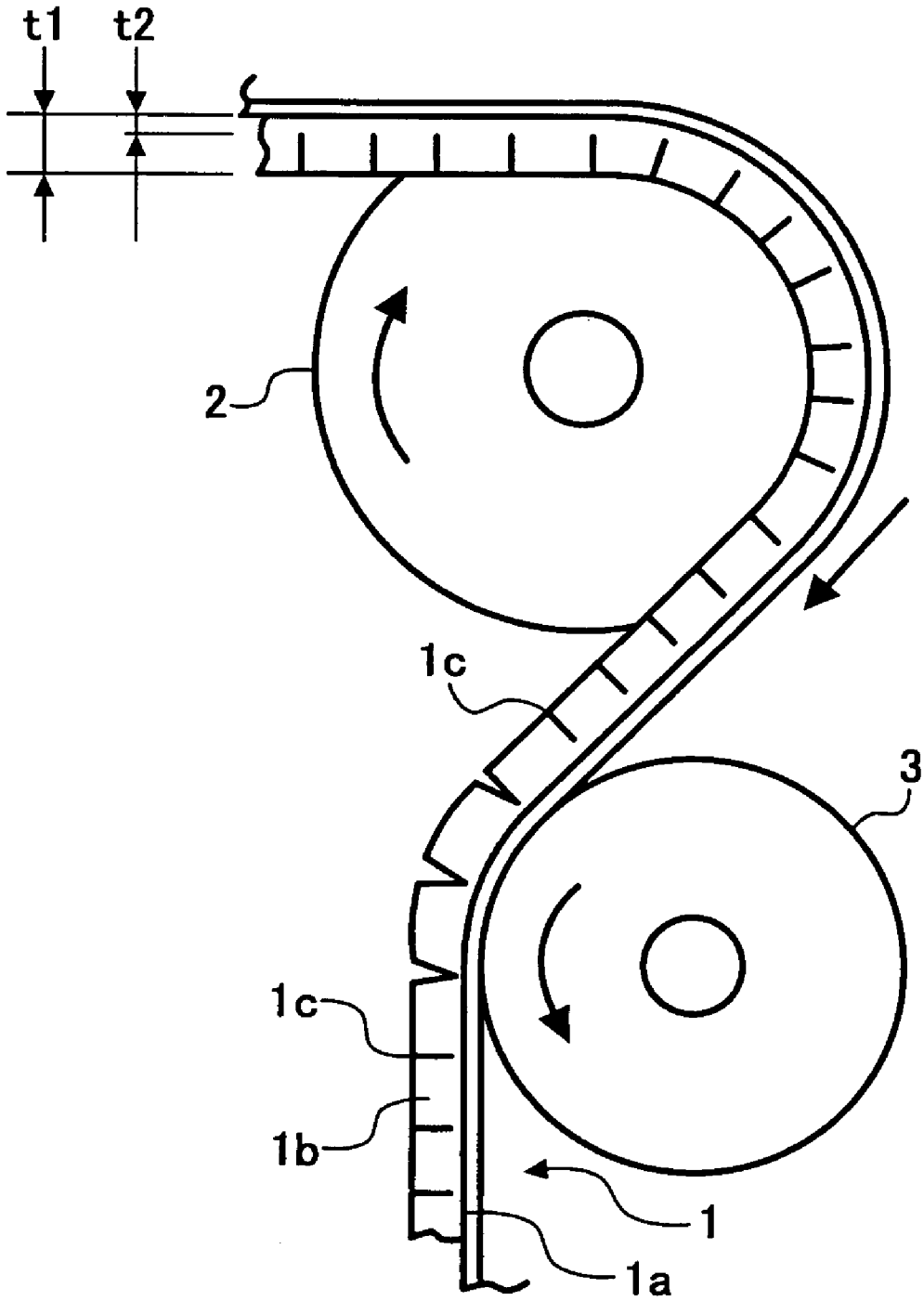
FIG. 4 is a side elevation showing a specific condition in which the belt member of FIG. 1 is passed over a support roller and pressed inward by a press roller.

FIG. 4 shows a specific condition in which the belt member 1 is passed over a support roller 2 and a press roller 3 pressing the outer surface of the belt member 1 toward the inside of the belt loop. The belt member 1 is passed over other support rollers, not shown, also and turned in a direction indicated by an arrow in FIG. 4. The belt member 1 is bent by the support roller 2 with a curvature large enough to wrap around the periphery of the support roller 2 and then inversely bent by the press roller 3 inward with a curvature large enough to wrap around the circumference of the press roller 3. As a result, the belt member 3 is turned inside out with the top of the rib 1*b* forming a larger arc than the bottom of the same. At this instant, a force, tending to extend the top of the rib 1*b* more than the bottom in the circumferential direction of the belt member 1, acts on the rib 1*b* at the position where the belt member 1 is inversely bent. Consequently, gaps appear between nearby portions of the rib 1*b* divided by the cuts 1*c*, as illustrated, so that the belt member 1 is inversely bent without the top of the rib 1*b* being stretched by force. With this configuration, it is possible to protect the rib 1*b* from deterioration ascribable to the inversely bent position of the belt member 1. Also, it is possible to prevent the belt member 1 from slipping on the support roller 2 due to the inversely bent position because the belt member 1 does not have to be made easily bendable or stretched by high tension.

Further, in the illustrative embodiment, the ribs 1*b* are formed integrally with the base 1*a*, i.e., the former is not adhered, deposited or otherwise fixed to the latter and is therefore prevented from coming off the latter, successfully extending the life of the belt member 1. To form the ribs 1*b* integrally with the base 1*a*, a cylindrical mold for forming the base 1*a* may be formed with annular grooves in the inner surface thereof by way of example.

Figure 5:
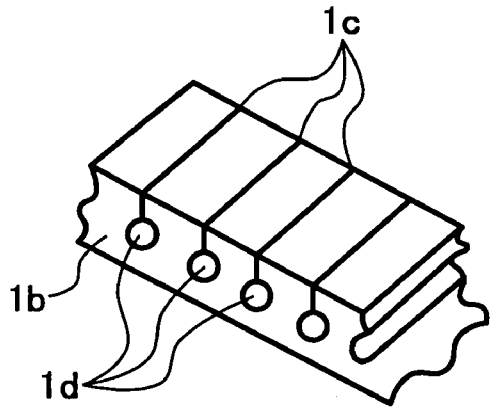
FIG. 5 is a fragmentary isometric view showing a modification of the first embodiment.

FIG. 5 shows a modification of the first embodiment of the belt member in accordance with the present invention, particularly the rib 1*b* of the belt member. As shown, bores 1*d* are formed in the rib 1*b* at preselected intervals in the circumferential direction of the belt member, and each extends throughout the rib 1*b* in the widthwise direction of the belt member. The bores 1*d* each are contiguous with a particular cut 1*c* also formed in the rib 1*b*.

More specifically, when the belt member 1 is inversely bent inward, as shown in FIG. 4, the slits 1*c* are enlarged in the form of V-shaped notches with the result that a force, tending to rip up the rib 1*b* at the cuts 1*c*, acts on the rib 1*b*. Such a force is apt to extend the ends of the cuts 1*c* toward the bottom of the rib 1*c* little by little. By contrast, the through bores 1*d*, FIG. 5, contiguous with the ends of the cuts 1*c* successfully release the ripping force concentrating on the ends of the cuts 1*c*, thereby preventing the cuts 1*c* from being extended little by little. This more surely protects the ribs 1*b* from deterioration.

While the through bores 1*d* are shown as being formed in one-to-one correspondence to the cuts 1*c*, each through bore 1*d* may be connected to a plurality of cuts 1*c* if the pitch of the cuts 1*c* is small.

Figure 6:
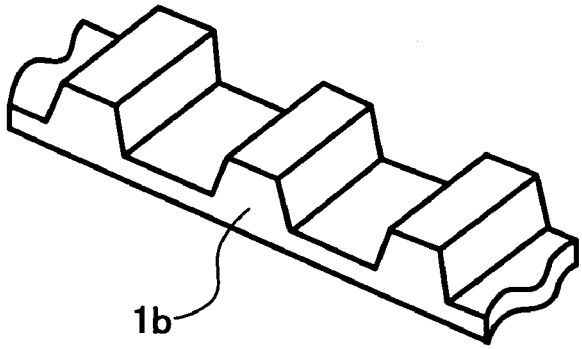
FIG. 6 is a fragmentary isometric view showing a second embodiment of the belt member in accordance with the present invention in an enlarged scale.

Reference will be made to FIG. 6 for describing a second embodiment of the present invention. The basic configuration of the second embodiment is identical with the basic configuration of the first embodiment and will not be described specifically in order to avoid redundancy. As shown, in the illustrative embodiment, the rib 1*b* is formed with a plurality of irregularities, i.e., projections and recesses alternating with each other in the circumferential direction of the belt member.

Figure 7:
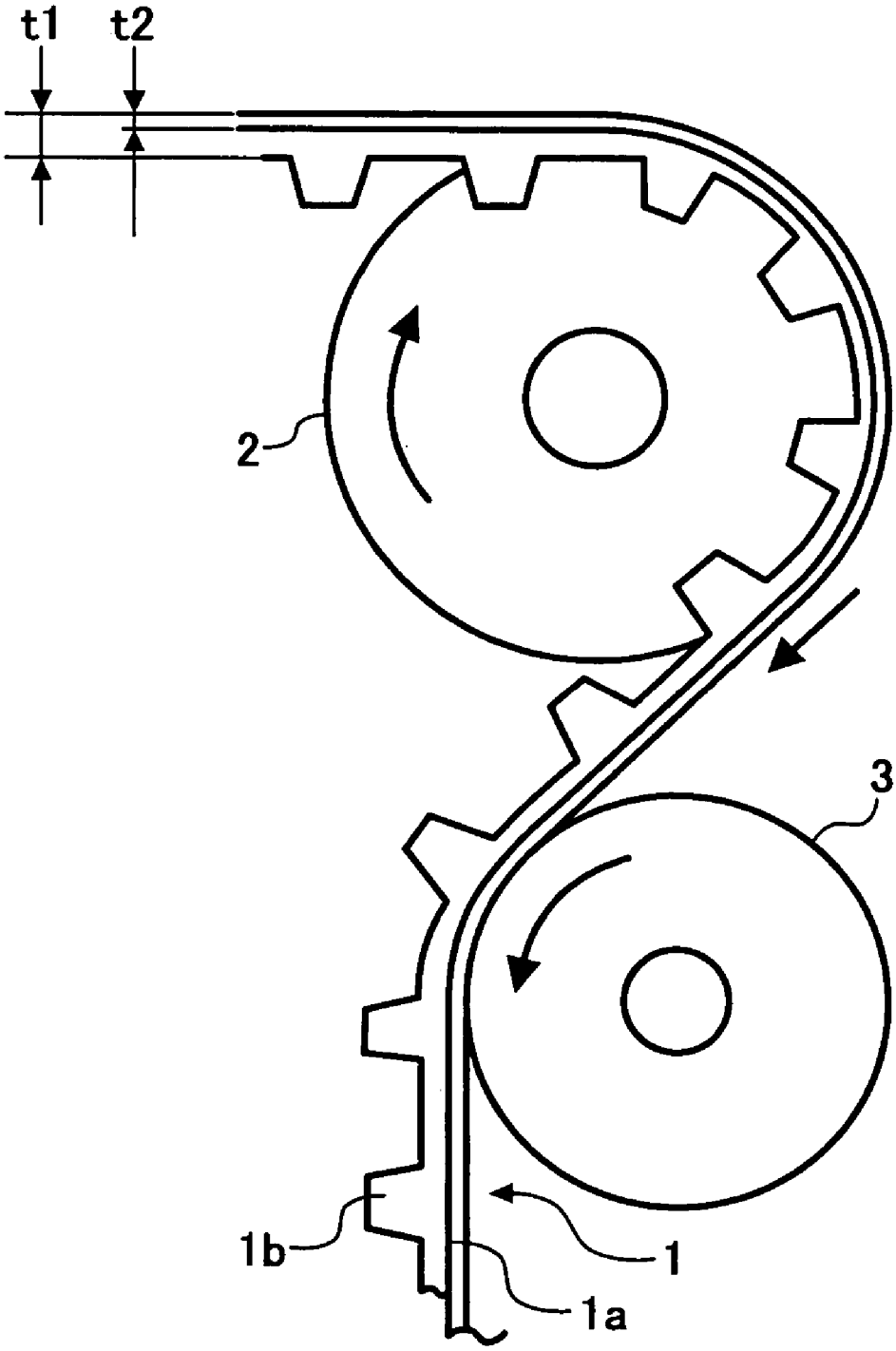
FIG. 7 is a side elevation showing a specific condition in which the belt member of FIG. 6 is passed over a support roller and pressed inward by a press roller.

FIG. 7 shows a specific condition in which the belt member 1 of the illustrative embodiment is passed over the support roller 2 and press roller 3 pressing the outer surface of the belt member 1 toward the inside of the loop. As shown, at the position where the belt member 1 is inversely bent by the press roller 3, the recesses of the rib 1*b*, forming part of the irregularities, are enlarged in the circumferential direction of the belt member 1 such that the distance between nearby projections, which form the other part of the irregularities, increases. This allows the belt member 1 to be inversely bent without the top of the rib 1*b* being stretched by force and therefore prevents the rib 1*b* from being deteriorated or slipping on the support roller 2.

Further, at the position where the belt member 1 is bent in such a manner as to wrap around the support roller 2, the recesses of the rib 1*b* are reduced in size in the circumferential direction of the belt member 1 such that the distance between nearby projections decreases. Consequently, the belt member 1 can wrap around the support roller 2 without the top of the rib 1*b* from being compressed by force. This reduces a load to act on the rib 1*b* and allows the belt member 1 to easily bend for thereby preventing the rib 1*b* from being deteriorated or slipping on the support roller 2 due to a large curvature.

In the illustrative embodiment, the rib 1*b* is formed separately from the base 1*a* and then adhered, deposited or otherwise fixed to the base 1*a*. In this configuration, the base 1*a* and rib 1*b* can be produced by different steps, rationalizing production by specialization. Further, a plurality of irregularities cooperate to reduce a load to act on the rib 1*b* for thereby preventing the rib 1*b* from coming off the base 1*a*. In the illustrative embodiment, the rib 1*b* does not have to be endless, but may be fixed to the base 1*a* at desired intervals, if desired.

Figure 8:
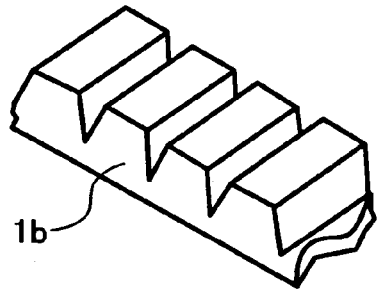
FIG. 8 is a fragmentary isometric view showing a modification of the second embodiment in an enlarged scale.

FIG. 8 shows a modification of the second embodiment. As shown, each recess formed in the rib 1*b* is provided with a generally V-shaped cross-section, as distinguished from the generally rectangular cross-section. The bottom of such a V-shaped recess may be rounded in order to prevent the rip from extending from the bottom of the sharp bottom.

Figure 9:
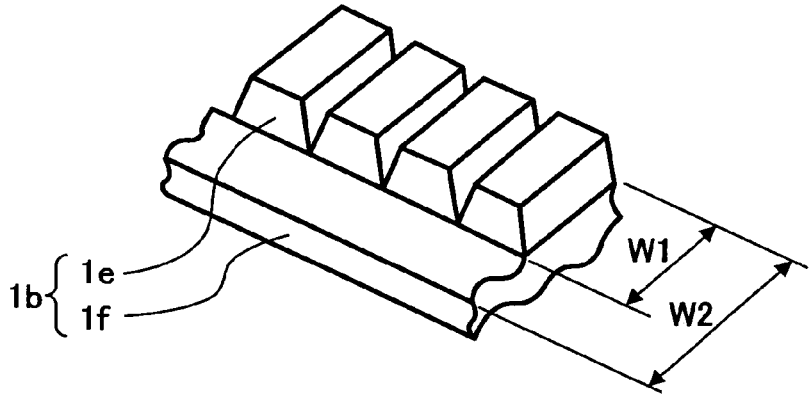
FIG. 9 is a view similar to FIG. 8, showing another modification of the second embodiment in an enlarged scale.

FIG. 9 shows another modification of the second embodiment. As shown, the lower end of each projection of the rib 1*b*, which is connected to the base 1*a*, has a widthwise dimension w2 greater than the widthwise direction w1 of the top of the projection. This increases the area over which the base 1*a* and rib 1*b* contact each other for thereby more surely preventing the rib 1*b* from coming off the base 1*a*.

When the rib 1*b* is formed separately from the base 1*a*, as in the illustrative embodiment, the thinnest portion of the rib 1*b* should preferably be 0.5 mm to 1.5 mm thick. Should the thinnest portion of the rib 1*b* be less than 0.5 mm thick, it would crease as easily as a thin film and would therefore make it extremely difficult to adhere the rib 1*b* to the base 1*a*. Should the thinnest portion be more than 1.5 mm thick, it would noticeably reduce the flexibility of the entire belt and make the belt member 1 difficult to bend although the rib 1*b* may be made of resin, rubber or similar elastic material.

Figure 10:
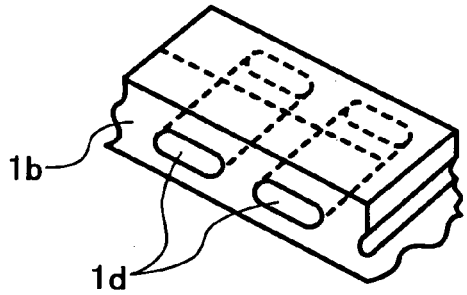
FIG. 10 is a fragmentary, enlarged isometric view showing a third embodiment of the belt member in accordance with the present invention.

Reference will be made to FIG. 10 for describing a third embodiment of the present invention. The basic configuration of the second embodiment is also identical with the basic configuration of the first embodiment and will not be described specifically in order to avoid redundancy. As shown, in the illustrative embodiment, the rib 1*b* is formed with a plurality of through bores 1*d* at preselected intervals in the circumferential direction of the belt member. With this configuration, the belt member easily deforms around the through bores 1*d* when inversely bent and can therefore wrap around the press roller 3, not shown, with a large curvature without the rib 1*b* being compressed or stretched by force. Consequently, the rib 1*b* is free from deterioration while the belt member 1, not shown, is prevented from slipping on the support roller 2 not shown. The through bores 1*d* formed in the rib 1*d* may be replaced with bores not extending throughout the rib 1*b*, if desired.

Figure 11:
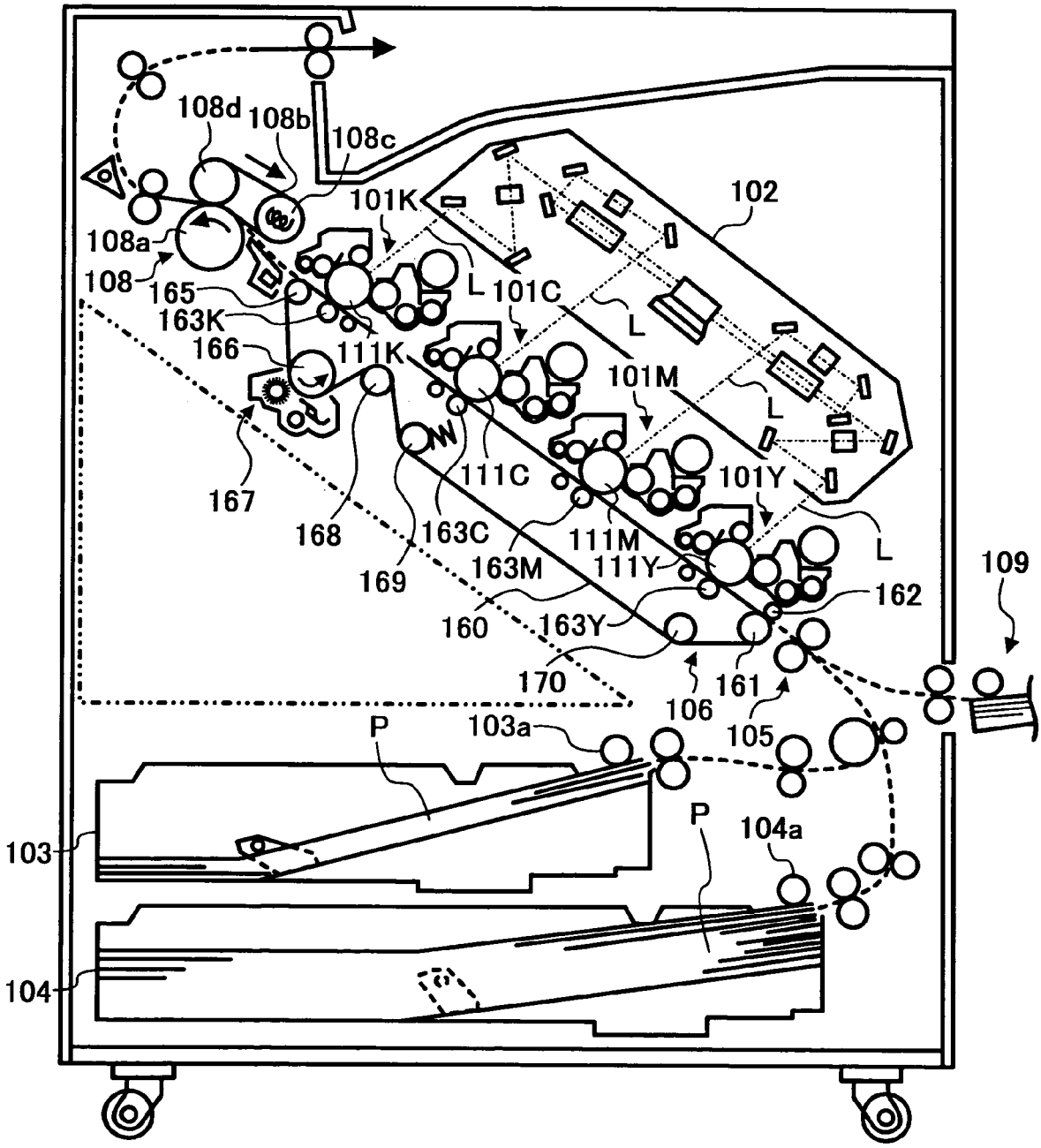
FIG. 11 is a view showing the general construction of a first embodiment of the image forming apparatus in accordance with the present invention.

Referring to FIG. 11, a first embodiment of the image forming apparatus in accordance with the present invention and implemented as an electrophotographic laser printer by way of example will be described. As shown, the laser printer includes four toner image forming sections 101Y (yellow), 101M (magenta), 101C (cyan) and 101K (black) for forming a Y, an M, a C and a K toner image, respectively. The laser printer further includes an optical writing unit 102, sheet cassettes 103 and 104, a registration roller pair 105, an image transferring device 106, a belt type fixing device 108, and a print tray 109. In addition, the laser printer includes toner containers each storing fresh toner of a particular color, a waste toner bottle and a power supply unit, although not shown specifically.

The toner image forming sections 101Y, 101M, 101C and 101K include photoconductive drums or image carriers 111Y, 111M, 111C and 111K, respectively. The optical writing unit 102 selectively emits laser beams L in accordance with image data received from, e.g., a personal computer not shown. The laser beams L each scan particular one of the drums 111Y through 111K in the dark for thereby electrostatically forming a latent image.

Figure 12:
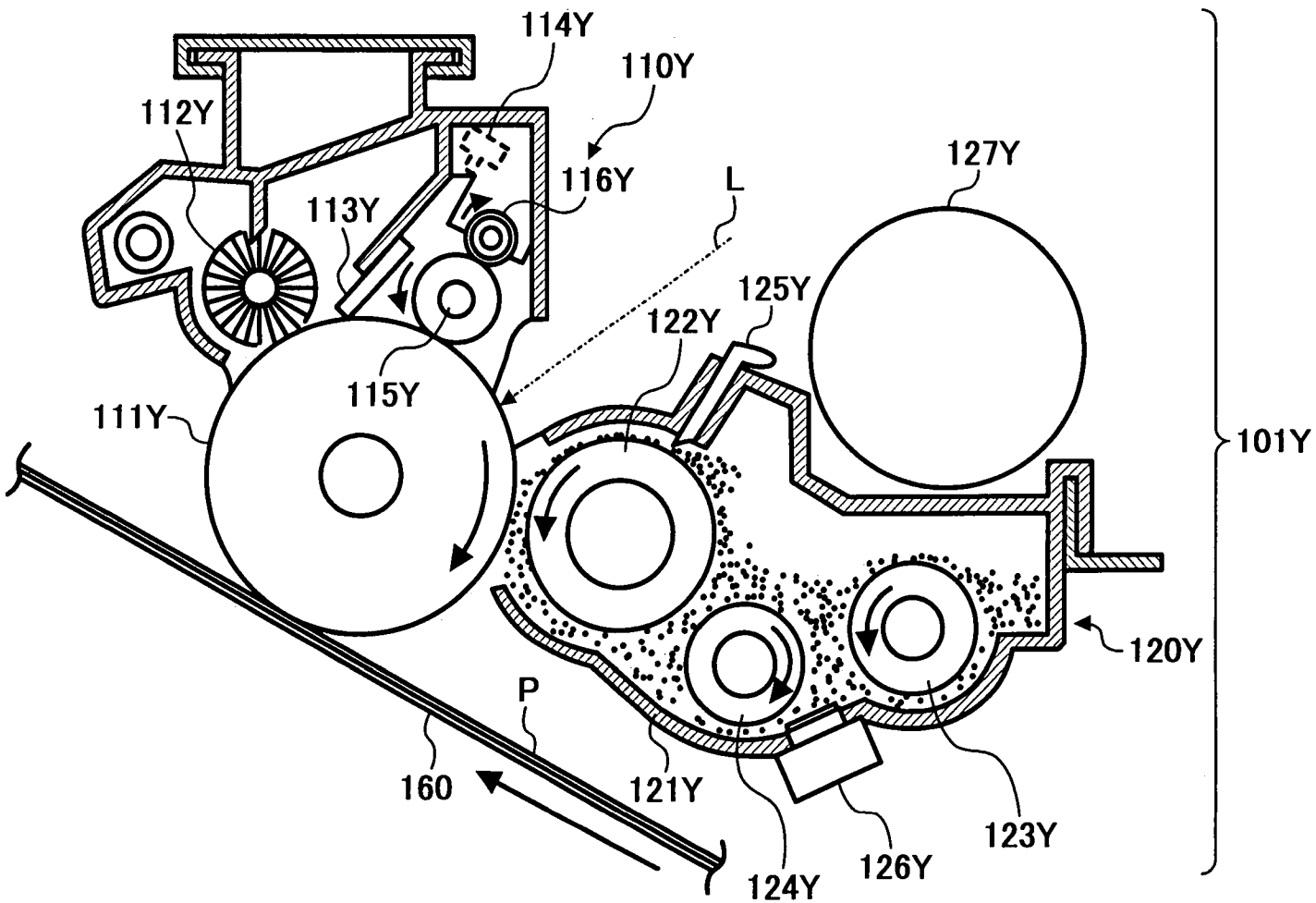
FIG. 12 is an enlarged view showing one of toner image forming sections included in the apparatus of FIG. 11 together with part of an image transferring device.

FIG. 12 shows a specific configuration of the toner image forming section 101Y by way of example together with part of the image transferring device 106. The other toner forming sections 101M, 101C and 101K are identical in configuration with the toner image forming section 101Y except for the color of toner to use and will not be described specifically. As shown, the toner image forming section 110Y includes a process unit 110Y and a developing unit 120Y.

The process unit 110Y includes a photoconductive drum 111Y, a brush roller 112Y for coating a lubricant on the drum 111Y, an angularly movable, counter blade or cleaning blade 113Y, and a quenching lamp or discharging lamp 114Y. The process unit 110Y additionally includes a charge roller 115Y for uniformly charging the surface of the drum 111Y and a cleaning roller Y for cleaning the surface of the drum, is applied with an AC bias from a power supply, not shown, and uniformly charges the surface of the drum 111Y while being rotated by drive means, not shown, in a direction opposite to the direction in which the surface of the drum 111Y moves, as seen at the position where the charge roller 115Y contacts the drum 111Y. The optical writing unit, FIG. 11, scans the surface of the drum 111Y thus charged by the charge roller 115Y with a laser beam L modulated and deflected, thereby forming a latent image on the above surface.

The developing unit 120Y includes a casing 121Y and a developing roller 122Y partly exposed to the outside via an opening formed din the casing 121Y. The developing unit 120Y further includes a first and a second screw 12Y and 124Y, respectively, a doctor 125Y, a toner content sensor (T sensor hereinafter) 126Y, and a portion 127Y fluidly communicated to a powder pump not shown.

A developer made up of magnetic carrier grains and Y toner grains, which are chargeable to negative polarity, is stored in the casing 121Y. The developer is sequentially conveyed by the first and second screws 123Y and 124Y while being charged by friction and then deposited on the surface of the developing roller 122Y. The developing roller 122Y conveys the developer deposited thereon to a developing zone where the roller 122Y faces the drum 111Y. At this instant, the doctor 125Y regulates the thickness of the developer forming a layer on the developing roller 122Y. In the developing zone, the Y toner contained in the developer is deposited on the Y latent image formed on the drum 111Y, producing a corresponding Y toner image. The developer thus lost the Y toner is returned to the casing 121Y in accordance with the rotation of the surface of the developing roller 122Y, i.e., a developing sleeve. On the other hand, the Y toner image is transferred from the drum 111Y to a paper sheet or similar recording medium P being conveyed by a belt member 160, which will be described specifically later.

The developing roller 122Y is made up of a developing sleeve implemented by a nonmagnetic pipe and driven by drive means, not shown, and a stationary magnet roller disposed in the sleeve. The developer is deposited on the surface of the sleeve by the magnetic force of the magnet roller.

The T sensor 126Y, comprising a permeability sensor, is mounted on the bottom of the casing 121Y and outputs a voltage corresponding to the permeability of the developer being conveyed by the second screw 124Y. More specifically, because the permeability of the developer is correlated to the toner content of the developer, the T sensor 126Y outputs a voltage corresponding to the Y toner content of the developer. The voltage thus output from the T sensor 126Y is sent to a controller not shown.

The controller includes, e.g., a RAM (Random Access Memory) storing a Y reference or target voltage Vtref assigned to the output voltage of the T sensor 126 as well as an M, a C and a K reference voltage Vtref assigned to the output voltages of T sensors included in the other developing units. As for the developing unit 120Y, the controller compares the output voltage of the T sensor 126Y with the Y reference voltage Vtref and drives the powder pump connected to a Y toner cartridge, not shown, for a period of time matching with the result of comparison. As a result, fresh Y toner is replenished from the Y toner cartridge to the developing unit 120Y via the communicating portion 127Y. This successfully replenishes an adequate amount of fresh Y toner to thereby control the Y toner content of the developer present in the developing unit 120Y to a preselected allowable range. This is also true with the other developing units.

As stated above, the toner image forming sections 101Y through 101K respectively form toner images, or visible images, on the drums or image carriers 111Y through 111K in cooperation with the optical writing unit 102. In this sense, in the illustrative embodiment, the toner image forming sections 101Y through 101K and optical writing unit 102 constitute, in combination, visible image forming means for forming toner images on the surfaces of the drums 111Y through 111K that make endless movement.

The two sheet cassettes 103 and 104, positioned in the lower portion of the printer, each are loaded with a stack of sheets P. A pickup roller 103*a* or 14*a* is pressed against the top sheet P of the sheet cassette 103 or 104, respectively, and driven at preselected timing to pay out the top sheet P toward a registration roller pair 105 via a sheet path. The registration roller pair 105 once stops the sheet P brought thereto and then drives it toward the image transferring device 106, which will be described later specifically, at such timing that the sheet P meets the Y toner image formed on the drum 111Y of the toner image forming section 101Y.

Figure 13:
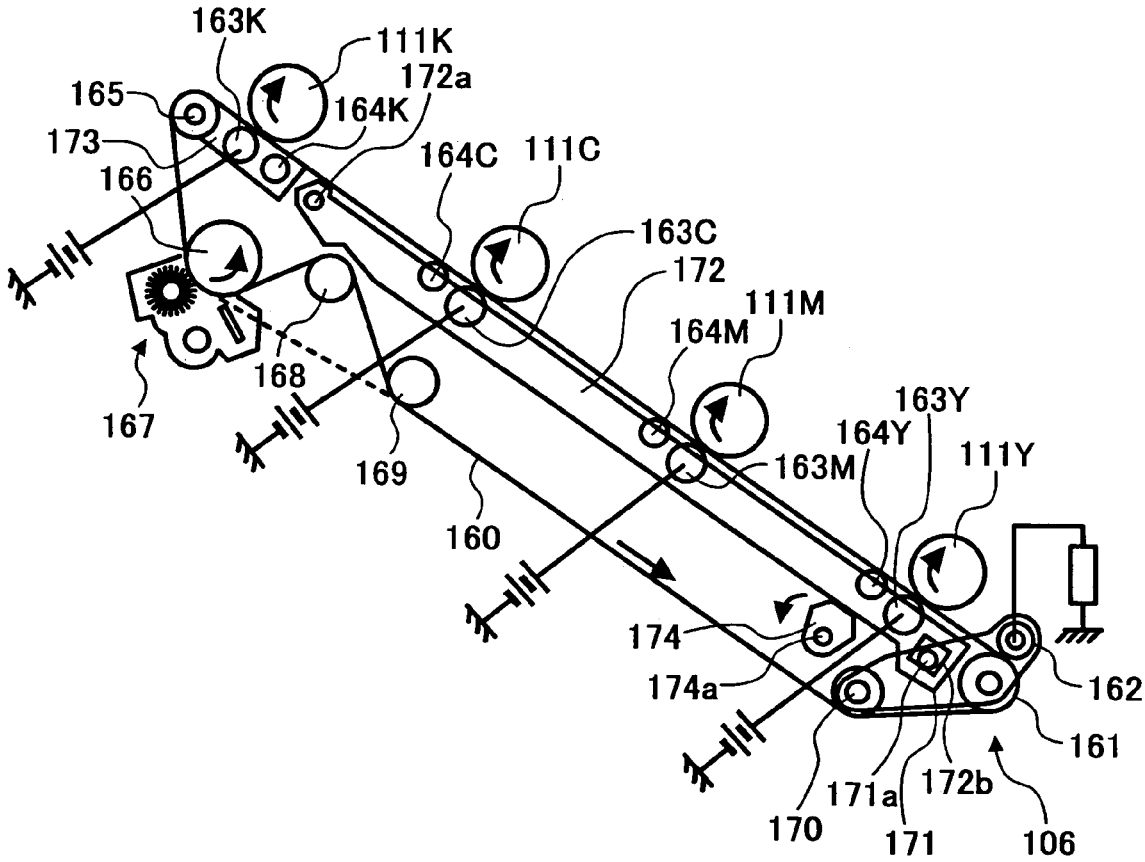
FIG. 13 is an enlarged view showing essential part of the image transferring device.

FIG. 13 is an enlarged view showing the essential part of the image transferring device 106. As shown, the image transferring device 106 includes a belt device made up of the belt member 106 and a plurality of support rollers supporting the belt member 106, i.e., an inlet roller 161, a separation roller 165, a drive roller 166, a tension roller 169, and a bottom roller 170. The image transferring device 106 further includes an electrostatic adhesion roller 162, four bias rollers 163Y through 163K, four support rollers 164Y through 164K, a belt cleaner 167, a press roller 168, an inlet bracket 171, a movable bracket 172, an outlet bracket 173, and a cam 174.

The belt member 160 is a high resistance, endless belt implemented as a single layer and having volume resistivity and surface resistivity controlled to $10^{10}$ Ωcm to Ω$10^{12}$ cm and $10^{12}$ Ω/□ to $10^{14}$ Ω/□, respectively. The belt member 160 is formed of PVDF (polyvinylidene fluoride). The drive roller 166 is rotated counterclockwise, as viewed in FIG. 13, by drive means, not shown, causing the belt 160 passed over the plurality of support rollers to turn counterclockwise.

The inlet roller 161, bias rollers 163Y through 163K, support rollers 164Y through 164K, separation roller 165, drive roller 166, tension roller 169 and bottom roller 170 all contact the inner surface of the belt member or belt loop 160. Among them, the inlet roller 161, located at the rightmost position in FIG. 13, nips the belt member 160 in cooperation with the electrostatic adhesion roller 162. The electrostatic adhesion roller 162, applied with an adhesion bias from a power supply, not shown, deposits a charge on the outer surface of the belt member 160, so that the sheet P fed from the registration roller pair 105 electrostatically adheres to the belt member 160.

The bias rollers 163Y through 163K each are made up of a metallic core and sponge or similar elastic material covering the core. The bias rollers 163Y through 163K are pressed toward the drums 111Y through 111Ka, respectively, nipping the belt member 160. As a result, an image transfer nip is formed between each of the drums 111Y through 111K and the belt member 160 over a preselected length in the direction of movement of the belt member 160. The image transfer bias is applied from the power supply to the cores of the bias rollers 163Y through 163K, so that a charge is deposited on the inner surface of the belt member 160 via each of the bias rollers. Consequently, electric fields for image transfer are formed between the belt 160 and the drums 111Y through 111K at the respective image transfer nips. The bias rollers 163Y through 163K may, of course, be replaced with any other suitable image transferring means, e.g., brushes, blades or chargers, if desired.

The bias rollers 163Y through 163C other than the bias roller 163K are mounted on the movable bracket 172 via respective bearing members not shown. The movable bracket 172 is positioned inside the loop of the belt member 160 and angularly movable about a shaft 172*a*. Three of the four support rollers 164Y through 164K are also mounted on the movable bracket 172. The cam 174 is positioned below the movable bracket 172, as viewed in FIG. 13, and rotated by drive means, not shown, about a shaft 174*a*. When the cam 174 is brought to a stop at a position where its cam surface abuts against the movable bracket 172, it causes the movable bracket 172 to angularly move about the shaft 172*a* counterclockwise, as viewed in FIG. 13. Consequently, the bias rollers 163Y through 163C are pressed against the drums 111Y through 111C, respectively, with the intermediary of the belt member 160, forming the image transfer nips mentioned previously. On the other hand, when the cam 174 is stopped at a position other than the position stated above, the movable bracket 172 is angularly moved about the shaft 172*a* clockwise, as viewed in FIG. 13, releasing the bias rollers 163Y through 163C from the belt member 160.

As stated above, in the illustrative embodiment, the image transferring device 106 with the movable bracket 172 selectively brings the belt member 160 into contact with the drums 111Y through 111C for forming the image transfer nips or brings the former out of contact with the latter.

The inlet roller 161, adhesion roller 162 and bottom roller 170 are mounted on the inlet bracket 171 via respective bearing members not shown. The inlet bracket 171 is disposed inside the loop of the belt 160 and angularly movable about the shaft of the bottom roller 170.

The movable bracket 172 is formed with a guide hole 172*b* at the left end portion thereof, as viewed in FIG. 13, while a pin 171*a* studded on the inlet bracket 171 is movably received in the guide hole 172*b*. In this condition, when the cam 174 is rotated to move the movable bracket 172 counterclockwise, the bracket 172 raises the pin 171 received in the guide hole 172. As a result, the inlet bracket 151 is turned about the shaft of the bottom roller 170 counterclockwise in interlocked relation to the bracket 172, raising the adhesion roller 162 and bottom roller 170. On the other hand, when the bracket 172 is moved clockwise, the inlet bracket 151 is also moved clockwise, lowering the inlet roller 161, adhesion roller 162 and bottom roller 170. Such movement of the inlet roller 161, adhesion roller 162 and bottom roller 170 interlocked to the movement of the bracket 172 is successful to maintain a sheet conveying surface formed by the belt member 160 straight.

When a toner image formed only in black is to be transferred to the sheet P, the movable bracket 172 is moved clockwise to release the belt 160 from the drums 111Y through 111C because the image transfer nips for Y, M and C toner images are not necessary. The black toner image can therefore be transferred to the sheet P without any unnecessary load acting on the belt member 160 or the driveline assigned thereto.

Among the four bias rollers 163Y through 163K, the bias roller 163K is mounted on the outlet bracket 173 via a bearing member not shown. The outlet bracket 173 is positioned inside the loop of the belt member 160 and angularly movable bout the shaft of the outlet roller 165. Among the four support rollers 164Y through 164K, the support roller 164 is also mounted on the outlet bracket 173 such that when the outlet bracket 173 is angularly moved clockwise, as viewed in FIG. 13, the support roller 164 moves to a position where it does not press the belt member 160 against the drum 111K. In this condition, when the movable bracket 172 is moved clockwise, the belt member 160 is released from all of the drums 111Y through 111K. The image transferring device 106 is mounted to or dismounted from the printer body when the belt member 160 is released from all of the drums 111Y through 111K, as stated above.

On the other hand, when a full-color image to be described specifically later should be transferred to the sheet P, the image transferring device 106 brings the belt member 160 into contact with all of the drums 111Y through 111K for thereby forming the nips for Y through K. The sheet P conveyed from the registration roller pair 160 is nipped by the adhesion roller 162 and belt member 160 and then sequentially conveyed via the Y through K image transfer nips while electrostatically adhering to the outer surface of the belt member 160. Consequently, a Y, an M, a C and a K toner image are sequentially transferred from the drums 111Y through 111K to the sheet P one above the other at the consecutive image transfer nips, completing a full-color image on the sheet P.

The endless belt member 160 conveys the sheet carrying the full-color image thereon to a position where the belt member 160 is passed over the separation roller 165. At this position, the separation roller 165 supports the belt member 160 at a wrapping angle great enough to substantially invert the direction of movement of belt member 160. The sheet P, electrostatically adhering to the belt 160, cannot follow such a sharp change in the direction of movement of the belt member 160 and is therefore separated from the belt member 160. The sheet P is then handed over to the fixing device 108, FIG. 11.

The tension roller 169 is constantly biased by a spring toward the belt member 160 to thereby apply preselected tension to the belt member 160. The press roller 168 is pressed against the outer surface of the belt member 160 between the tension roller 169 and the drive roller 166, inversely bending the belt member 160. The belt member 160 is therefore curved toward the inside of the loop with a large curvature, so that the belt member 160 is allowed to wrap around the drive roller 166 by a greater angle. The belt cleaner 167 is held in contact with the outer surface of the above portion of the belt member 160 in order to remove toners undesirably transferred from the drums 111Y through 111K to the outer surface of belt member 160 from which the sheet P has been separated.

Referring again to FIG. 11, the fixing device 108 includes a press roller 108*a*, a fixing belt or belt member 108*b*, a heat roller 108*c*, and a drive roller 108*d*. The fixing belt 108*b* is passed over the heat roller 108*c* and drive roller 108*d* and caused to endlessly turn clockwise, as viewed in FIG. 11, by the driver roller 108*d* driven by drive means not shown. The heat roller or heating means 108*c*, accommodating a halogen lamp or similar heat source, heats the belt member 108 at the inside of the belt member 108. The press roller or contact roller 108*a*, contacting the fixing belt 108*b*, is caused to turn in the same direction as the belt member 108*b* while forming a nip for fixation. The sheet P, handed over from the belt member 160 of the image transferring device 106 to the fixing device 108, is nipped at the above nip with its image surface contacting the fixing belt 108*b*. With this configuration, the fixing device 10 fixes the full-color toner image on the sheet P with heat and pressure.

The sheet or print P, coming out of the fixing device 108, is conveyed to a stack portion positioned on the top of the printer body via roller pairs and a guide plate.

As shown in FIG. 12, the brush roller 112Y coats a preselected amount of lubricant on part of the drum 111Y moved away from the Y image transfer nip. Subsequently, the counter blade 113Y cleans the surface of the drum 111Y, and then the quenching lamp 114Y optically discharges the surface of the drum 111Y for thereby preparing it for the next image formation. The cleaning roller 116Y removes the toner left on the drum 111Y without being removed by the counter blade 113Y.

Arrangements unique to the printer of the illustrative embodiment will be described hereinafter. In FIG. 13, the support rollers included in the belt device each are provided with a dimension, as measured in the widthwise direction of the belt member 160, smaller than the width of the belt member 160. The belt member 160 is formed with the irregularities shown in FIG. 7 at a pitch that allows a plurality of projections to abut against the end face of each of all support rollers at the same time. With this configuration, it is possible to prevent the belt member 160 from running off the support rollers, compared to a case wherein only a single projection abuts against the end face of a single support roller.

The press roller 168, included in the image transferring device 106, presses the outer surface of the belt member 160 in such a manner as to inversely bend the belt member 160 inward of the belt loop, as stated earlier. In this condition, some member can be positioned in the space formed by the resulting concave portion of the belt member 160, so that free layout around the belt member 160 is enhanced and promotes size reduction of the entire printer. In the illustrative embodiment, part of the belt cleaner or belt cleaning means 167 is positioned in the above space, as indicated by a dashed line in FIG. 13. It is therefore possible to remove the toner undesirably deposited on the belt member 160 while implementing compact layout.

The drive roller 166, which is one of a plurality of support rollers, plays the role of a cleaning backup roller that nips the belt member 160 between it and the belt cleaner 167. Stated another way, in the illustrative embodiment, drive means, not shown, is configured to drive a cleaning backup roller, which is one of a plurality of support rollers. Consequently, a drive force is applied to the belt member 160 at a cleaning position where the belt cleaner 167 and cleaning backup roller, expected to nip the belt member 160 therebetween, eventually obstruct the movement of the belt member 160.

The belt member 160 therefore slips less than when a cleaning backup roller simply follows the movement of the belt member 160.

The belt cleaner 167 should preferably be positioned adjacent to the press roller 168 at the upstream side of the press roller 168 in the direction of movement of the belt member 160. In this configuration, the press roller 168 presses the outer surface of the belt member 160 cleaned by the belt cleaner 167 with its center portion 168*a*, see FIG. 14, and therefore does not cause toner undesirably deposited on the outer surface of the belt member 160 to adhere.

Figure 14:
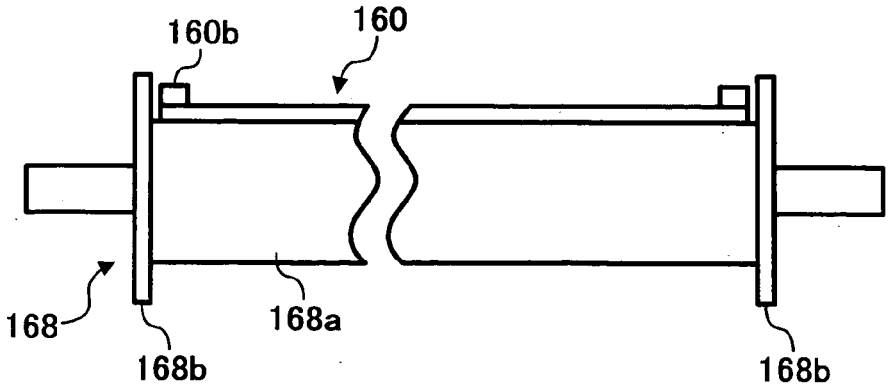
FIG. 14 is a partly cut away front view showing a press roller included in the image transferring device together with a belt member.

FIG. 14 is a partly taken away front view showing the press roller 168 together with the belt member 160. As shown, the press roller 168 is constituted by the center portion 168*a* and opposite end portions implemented as radially outward projections 168*b*. The center portion 168*a* presses the outer surface of the belt member 160, as stated above. The projections 168*b* abut against the opposite edges of the belt member 160 for thereby preventing the belt member 160 from being shifted on the press roller 168.

In the illustrative embodiment, the projections 168*b* of the press roller 168 are implemented as flange members or similar members produced separately from the center portion 168*a*. With this configuration, it is possible to mount only the center portion 168*a* to the printer body and then mount the projections 168*b* to the center portion 168*a* for thereby completing the press roller 168. It follows that the press roller 168 can be mounted to the printer body from one side in the widthwise direction of the belt member 160 by single-action work, as distinguished from the following double-action work. The double-action work consists of inserting the press roller 168 into the printer body at a position relatively remote from the belt member 160 while preventing the projections 168*b* from catching the belt member 160, and then horizontally moving the press roller 168 into contact with the outer surface of the belt member 160. By contrast, in the illustrative embodiment, only the center portion 168*a* can be inserted into the printer body while sliding on the belt member 160 because the projections 168*b* are absent, omitting the horizontal movement. This makes it unnecessary to provide a space for the horizontal movement around the belt member 160 for thereby further promoting free layout and, in addition, facilitates the operation for mounting the press roller 168 to the printer body.

In the illustrative embodiment, the support rollers, supporting the belt member 160, each are provided with a diameter ranging from 16 mm to 30 mm for the following reasons. To wrap the belt member 160 around a support roller having a diameter smaller than 16 mm, i.e., an extremely large curvature 1/R, which is the reciprocal of a diameter, it is necessary to stretch even the belt member 160 of the illustrative embodiment with great tension, causing the belt member 160 to easily slip on the support roller. On the other hand, while one of the support rollers must serve as a separation roller (165 in the illustrative embodiment) for separating the sheet P from the outer surface of the belt member 160, it is difficult for such a roller to exhibit the expected function if its diameter is larger than 30 mm. More specifically, the belt member 160 is wrapped around the major part of the circumference of the separation roller in order to substantially invert the path of movement of the belt member 160, so that the sheet P can be separated from the outside of the belt member 160 with its own elasticity without regard to the sharp change in the direction of movement of the belt member 160. Such separation of the sheet P is obstructed if the curvature of the separation roller is small. In image forming apparatuses in general, when the diameter of the separation roller exceeds 30 mm, the separability of the sheet P critically falls.

In the illustrative embodiment, the press roller 168, pressing the outer surface of the belt member 160 inward, is provided with a diameter ranging from 16 mm to 60 mm for the following reasons. Again, to wrap the belt member 160 around a support roller having a diameter smaller than 16 mm, i.e., an extremely large curvature, it is necessary to stretch even the belt member 160 of the illustrative embodiment with high tension, causing the belt member 160 to easily slip on the support roller. On the other hand, when the press roller 168 is provided with a diameter larger than 60 mm, the press roller 168 occupies most part of the space formed by the inversely bent portion of the belt member 160, obstructing free layout.

In the illustrative embodiment, the belt member shown in FIG. 7 is applied to the fixing belt 108*b* of the fixing device 108, FIG. 11, also. It is therefore possible to reduce the size of the fixing device 108 by wrapping the fixing belt 108*b* with a large curvature while obviating the deterioration of the ribs and slippage of the fixing belt 108 ascribable to the large curvature.

Figure 15:
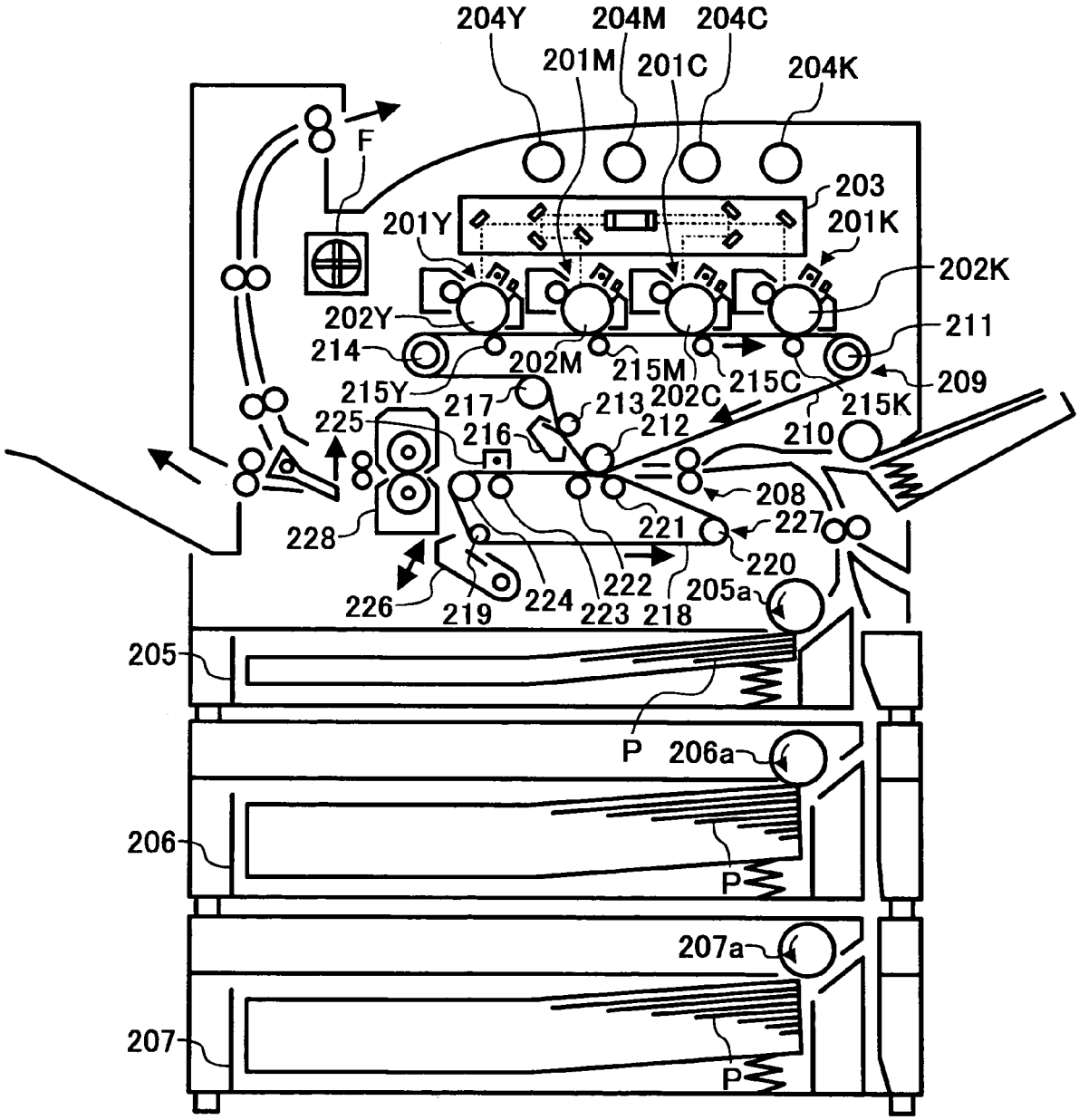
FIG. 15 is a view showing a second embodiment of the image forming apparatus in accordance with the present invention.

Referring to FIG. 15, a second embodiment of the printer in accordance with the present invention is shown and includes four toner image forming sections 201Y, 201M, 201C and 201K like the previous embodiment. As shown, the toner image forming sections 201Y through 201K include photoconductive drums 202Y through 202K, respectively, as in the previous embodiment. An optical writing unit 203 is positioned above the toner image forming sections 201Y through 201K while toner bottles 204Y through 204K, removably mounted to the printer body, are arranged above the optical writing unit 203. The toner bottles 204Y through 204K respectively store fresh Y, M, C and K toners to be replenished to developing units included in the toner image forming sections 201Y through 201K. Three sheet cassettes 205, 206 and 207 are arranged one above the other in the lower portion of the printer body for feeding sheets P loaded thereon toward a registration roller pair 208.

A first image transferring unit or device 209 is arranged below the toner image forming sections 201Y through 201K and includes a first endless, intermediate image transfer belt or belt member 210 passed over a plurality of support rollers. The support rollers comprise a drive roller 211, a secondary image transfer backup roller 212, a first cleaning backup roller 213, and a tension roller 214. The first image transferring unit 209 further includes four primary image transfer rollers 215Y, 215M, 215C and 215K serving as image transferring means, a first belt cleaner or cleaning means 216, and a press roller 217. The first intermediate image transfer belt (simply first belt hereinafter) 210, passed over the support rollers, is caused to turn clockwise, as viewed in FIG. 15. The primary image transfer rollers 215Y through 215K nip the first belt 210 between them and the drums 202Y through 202K, respectively, forming consecutive nips for primary image transfer. While the illustrative embodiment applies a primary image transfer bias opposite in polarity to toner, e.g., a bias of positive polarity to the inner surface of the belt 210 via the rollers 215Y through 215K, the rollers 215Y through 215K may be replaced with chargers each including a discharge electrode.

The first belt 210 moves via the consecutive Y, M, C and K nips for primary image transfer. At the Y, M, C and K nips, Y, M, C and K toner images formed on the drums 202Y, 202M, 202C and 202K, respectively, are sequentially transferred to the belt 210 by nip pressure and bias, completing a four-color toner image on the belt 210 (primary image transfer). The secondary image transfer backup roller 212 is so positioned as to bite into a second image transfer belt (simply second belt hereinafter) 218, which will be described later specifically, forming a nip for secondary image transfer where the two belts 210 and 218 contact each other over a substantial circumferential length. The four-color toner image carried on the first belt 210 is transferred to the second belt 218 or a sheet P at the secondary image transfer nip (secondary image transfer).

The first belt cleaner 216 removes toners left on the first belt 210 moved away from the secondary image transfer nip without being transferred to the second belt 218 or the sheet P.

A secondary image transferring unit 227 is positioned below the primary image transferring unit 209 and includes the endless second belt 218. The second belt 218 is passed over a plurality of rollers, i.e., a second cleaning backup roller 219, a tension roller 220, a nip inlet roller 221, a secondary image transfer roller 222, a tertiary image transfer backup roller 223, and a separation roller 224. The secondary image transferring unit 227 further includes a tertiary image transfer charger or image transferring means 225 and a second belt cleaner or cleaning means 226.

The second cleaning backup roller 219 is driven to cause the second belt 218 to turn counterclockwise, as viewed in FIG. 15. The secondary image transfer roller 222 is implemented as a metallic roller or a roller made up of a metallic core and a conductive rubber layer covering the core and is applied with a bias for secondary image transfer from a power supply not shown. The bias for secondary image transfer is opposite in polarity to tone, i.e., of positive polarity. The other rollers of the second image transferring unit 227 all are connected to ground.

The registration roller pair 208 stops the sheet P brought thereto and then conveys it toward the secondary image transfer nip at such timing that the sheet P meets the four-color toner image carried on the first belt 210. The registration roller pair 208, however, does not convey the sheet P if the four-color toner image is a first toner image to be transferred to a first surface of the sheet P, i.e., the surface facing upward in the sheet cassette. As a result, the first toner image on the first belt 210 is transferred to the second belt 218 at the secondary nip by nip pressure and secondary image transfer bias. On the other hand, if the four-color toner image on the first belt 210 is a second toner image to be transferred to a second surface of the sheet P, then the registration roller pair 208 conveys the sheet P such that the sheet P meets the second toner image, so that the second toner image is transferred to the second surface of the sheet P and forms a full-color image in combination with white, which is the color of the sheet P. At this instant, although the first toner image, nipped between the first surface of the sheet P and the second belt 218 at the secondary image transfer nip, is pulled toward the belt 218 by the secondary image transfer bias and therefore closely contacts the first surface of the sheet P, the first toner image is not transferred to the first surface of the sheet P.

In the first image transferring unit 209, the secondary image transfer backup roller 212 supports the first belt 210 in such a manner as to substantially invert the direction of movement of the belt 210 and presses part of the belt 210 being inverted in direction against the secondary belt 218 to thereby form the secondary image transfer nip. Consequently, the sheet P is separated from the primary belt 210 at the outlet of the secondary image transfer nip and conveyed by being retained only by the surface of the second belt 218. In the secondary image transferring unit 227, the sheet P thus retained by the second belt 218 is conveyed to a tertiary image transfer position where the tertiary image transfer charger 225 faces the outer surface of the second belt 218 at a preselected distance. The tertiary image transfer charger 225 applies a charge of, e.g., positive polarity opposite to the polarity of toner to the second surface of the sheet P being conveyed by the second belt 218. As a result, the first toner image between the first surface of the sheet P and the second belt 218 is transferred to the first surface of the sheet P, completing a full-color image (tertiary image transfer).

As stated above, in the illustrative embodiment, the first and second image transferring units 209 and 227 constitute a duplex image transferring device for transferring four-color toner images to both surfaces of a single sheet or recording medium P. It is to be noted that the rollers, constituting members to which the primary and secondary biases are applied, may be replaced with brushes or the like and that the electrostatic image transfer system using biases to such members may be replaced with a non-contact type discharge system.

The separation roller 224 supports the second belt 218 in such a manner as to bend it at substantially 90°. In this condition, the leading edge of the sheet P, moved away from the tertiary image transfer position, is separated from the second belt 218 around the bent portion of the belt 216 and advances straightforward to a fixing device 228.

The fixing device 228 includes two heat rollers each accommodating a halogen lamp or similar heating means, not shown, and forming a nip for fixation in contact with each other. The heat rollers, moving in the same direction at each other at the point of contact, heat the sheet P brought to the above nip at both sides of the sheet P. As a result, the full-color images carried on both surfaces of the sheet P are fixed by heat. The sheet or duplex print P, coming out of the fixing device 228 is driven out to a stack portion positioned on the top of the printer body.

The second cleaning backup roller 219 and second belt cleaner 226 nip the second belt 218 moved away from the tertiary image transfer position in order to mechanically or electostatically remove toner left on the belt 218. Should the second belt cleaner 226 be constantly held in contact with the second belt 218, the first toner image transferred to the second belt 218 by the secondary image transfer would also be removed. To solve this problem, the second belt cleaner 226 is selectively moved into or out of contact with the second belt 218 by being angularly moved by a moving mechanism not shown, as indicated by a double-headed arrow in FIG. 15. More specifically, the second belt cleaner 226 is released from the second belt 218 at least when the first toner image is conveyed via the belt cleaner 226.

As stated above, in the illustrative embodiment, the first toner image is formed before the second toner image, transferred from the first belt 210 to the second belt 218 at the secondary image transfer nip, and then transferred to the first surface of the sheet P, which will face upward at the stack portion, at the tertiary image transfer position. Consequently, consecutive sheets P are sequentially stacked on the stack portion with the first and second toner images thereof facing upward and downward, respectively. In the illustrative embodiment, to sequentially stack such sheets P in an incrementing order as to page, one of images on an odd and an even page smaller in page number is formed first as the first toner image. For example, an image on the second page is formed as the first toner image before an image on the first page. Then, even when several pages of documents are continuously output, the resulting prints are sequentially stacked with the first page at the bottom. However, in a simplex print mode for forming images only on the second surfaces of sheets P, an image with a smaller page number is formed first and then transferred to the second surface of a sheet P by the secondary image transfer. As a result, even in the simplex print mode, prints are sequentially stacked on the stack portion in the incrementing order as to page.

The second toner images formed on the four drums 202Y through 202K are non-mirror images because they change to mirror images and then to non-mirror images at the primary and secondary image transfer stations before transferred to the sheet P. More specifically, the non-mirror image formed on each drum is a non-mirror image when transferred to the second surface of the sheet P also. By contrast, the first toner image, subjected to the tertiary image transfer in addition to the first and second image transfer, is formed on each drum as a mirror image and therefore transferred to the first surface of the sheet P as a non-mirror image.

Configurations unique to the illustrative embodiment will be described hereinafter. In FIG. 15, the support rollers included in each of the belt devices of the first and second image transferring units 209 and 227 each are provided with a dimension, as measured in the widthwise direction of the belt 210 or 218, smaller than the width of the belt. Each belt 210 or 218 is formed with the irregularities shown in FIG. 7 at a pitch that allows a plurality of projections to abut against the end face of each of all support rollers at the same time. With this configuration, it is possible to prevent the belt member 160 from running off the support rollers, compared to a case wherein only a single projection abuts against the end face of a single support roller.

The press roller 217, included in the first image transferring unit 209, presses the outer surface of the first belt 210 in such a manner as to inversely bend the belt 210 inward of the belt loop. In this condition, some member can be positioned in the space formed by the resulting concave portion of the first belt 210, so that free layout around the belt 210 is enhanced and promotes size reduction of the entire printer. In the illustrative embodiment, part of the first belt cleaner or belt cleaning means 216 is positioned in the above space. It is therefore possible to remove the toner undesirably deposited on the first belt 210 while implementing compact layout.

Particular drive means, not shown, drives each of the first and second cleaning backup rollers 212 and 224, thereby causing the intermediate image transfer belts 210 and 218 to turn. The belts 210 and 218 therefore slip less than when cleaning backup rollers simply follow the movement of the belts.

The press roller 217 is made up of a center portion and radially outward projections positioned at axially opposite ends of the center portion as in the previous embodiment, although not shown specifically. The center portion presses the outer surface of the first belt 210. This prevents the first belt 210 from being shifted on the press roller 217 as well. Further, the projections of the press roller 217 are produced separately from the center portion as in the previous embodiment, further promoting free layout and facilitating the operation for mounting the press roller 217.

The rollers included in the first and second image transferring units 209 and 227 all are provided with a diameter of 16 mm to 30 mm. The press roller 217 is provided with a diameter of 16 mm to 60 mm.

Figure 16:
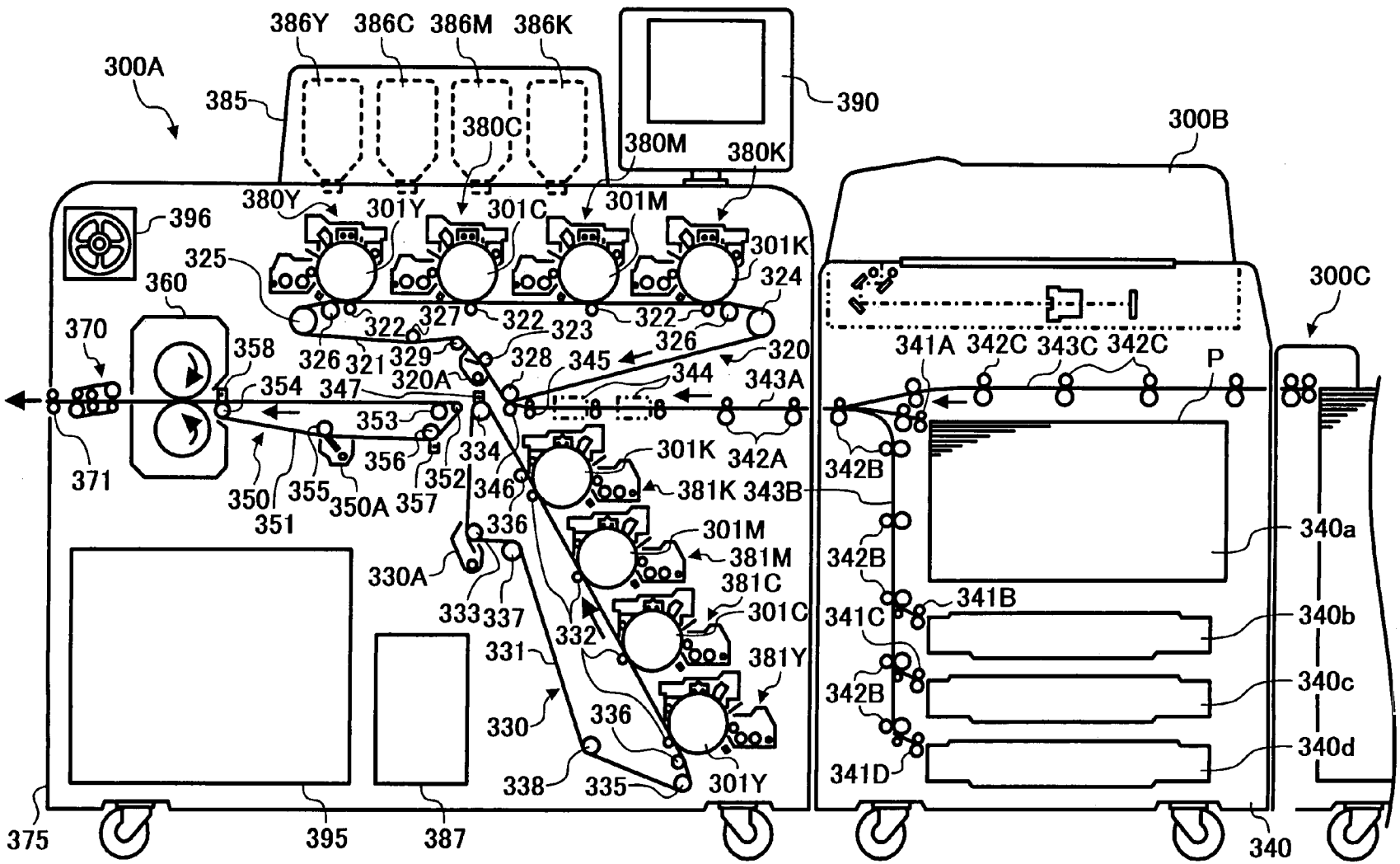
FIG. 16 is a view showing the third embodiment of the image forming system in accordance with the present invention.

Reference will be made to FIG. 16 for describing a third embodiment of the image forming apparatus in accordance with the present invention and implemented as an electrophotographic color image forming system by way of example. As shown, the color image forming system is generally made up of a printer 300A, an operation and display unit 390, a sheet feeder or sheet feeding device 340, an ADF (Automatic Document Feeder) 300B, and another sheet feeder 300C.

The printer 300A includes a first and a second image forming section 320 and 330 respectively arranged above and below a sheet path 343A. The first and second image forming sections 320 and 330 respectively include a first and a second intermediate image transfer belt (first and second belt hereinafter) 321 and 331 each being endlessly movable in a particular direction indicated by an arrow in FIG. 16. Four toner image forming sections 380Y, 380M, 380C and 380K are positioned above the upper run of the first belt 321. Four toner image forming sections or second toner image forming means 381Y, 381M, 381C and 381K are located at the side of one opposite side runs of the second belt 331.

The toner image forming sections 380Y through 380K and 381Y through 381K include photoconductive drums or image carriers 301Y through 301K, respectively. The drums 301Y through 301K of the first toner image forming sections 380Y through 380K are arranged at equal intervals and caused to contact the outer surface of the upper run of the first belt 321 at least when image formation is under way. Let the outer surface of the first belt 321 be referred to as a first image-receiving surface. The drums 301Y through 301K of the second toner image forming sections 381Y through 381K are also arranged at equal intervals and caused to contact the outer surface of the side run of the second belt 331 at least when image formation is under way. The outer surface of the second belt 331 will be referred to as a second image-receiving surface hereinafter.

The first belt 321 is passed over a plurality of rollers in a horizontally long position, which occupies a greater space in the horizontal direction than in the vertical direction, with the first image-receiving surface thereof extending substantially horizontally. The first toner image forming sections 380Y through 380K are arranged side by side in substantially the horizontal direction in such a manner as to contact the substantially horizontal, first image-receiving surface. On the other hand, the second belt 331 is inclined from the top left toward the bottom right, as viewed in FIG. 16. The second toner image forming sections 281Y through 381K are arranged side by side at the right-hand side of the second belt 331 in such a manner as to contact the second image-receiving surface of the thus inclined second belt 331.

Figure 17:
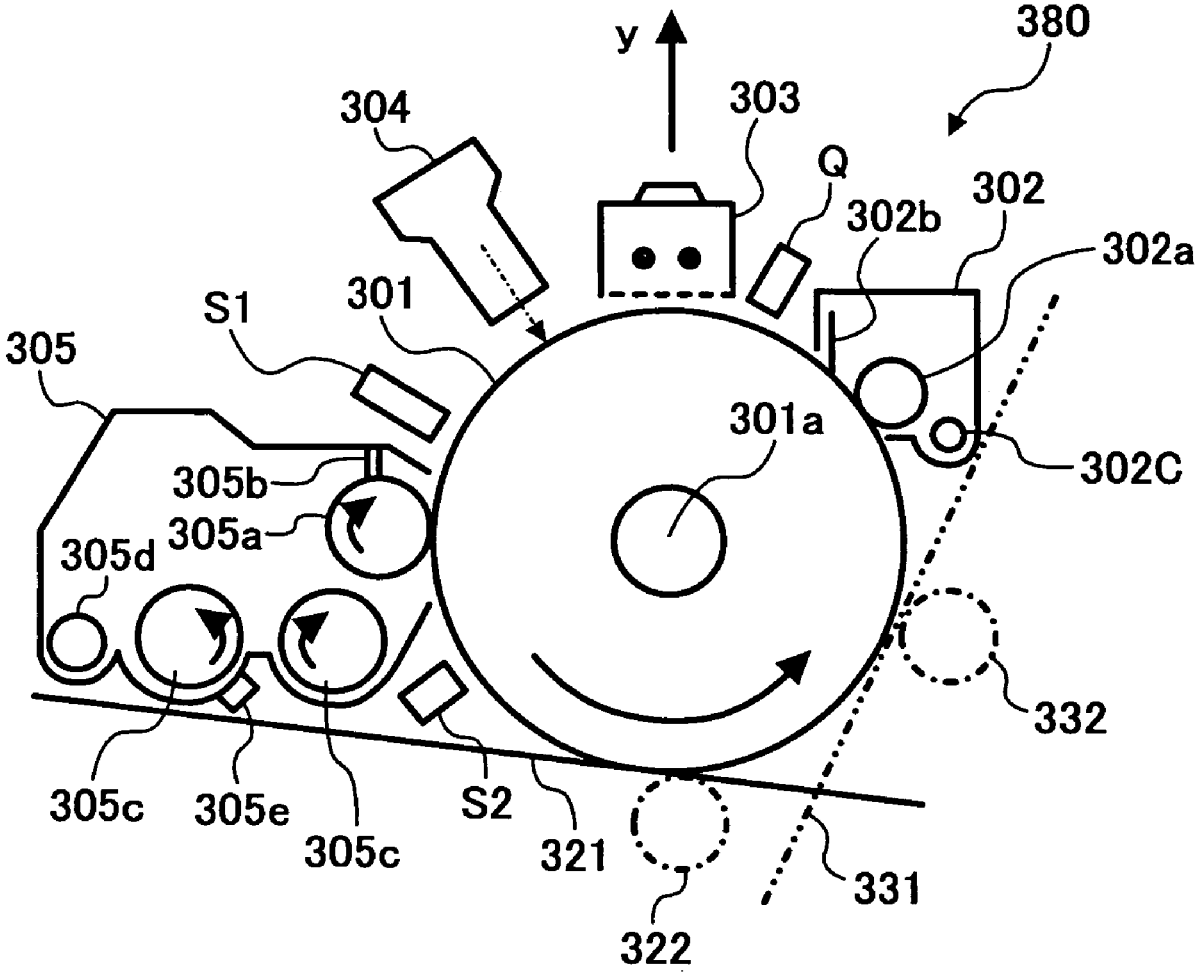
FIG. 17 is an enlarged view showing one of first toner image forming sections included in the third embodiment.

FIG. 17 shows one of the first toner image forming sections 380Y through 380K in an enlarged scale. Because the first toner image forming sections 380Y through 380K are substantially identical in configuration except for the color of toner to use, the suffix Y, M C or K attached to the reference numeral 380 is omitted. As shown, the drum 301 is rotated counterclockwise, as viewed in FIG. 17, by drive means, not shown, when the printer 300A is in operation. Arranged around the drum 301 are a scorotron charger or charging means 303, an exposing device 304, a developing unit or device 305, a belt cleaner 320A, a quenching lamp Q and other image forming members, a potential sensor S1 and an image sensor S2.

The drum 301 is made up of a hollow, aluminum cylinder having a diameter of, e.g., about 30 mm to 120 mm and an OPC (Organic PhotoConductor) layer formed on the cylinder. The OPC layer may be replaced with an amorphous silicone (a-Si) layer, if desired. The drum 310 may, of course, be replaced with a photoconductive belt.

The drum cleaner 302 includes a cleaning member implemented as a brush or a blade and a collecting member and is configured to remove toner left on the surface of the drum 301 moved away from a primary image transfer nip, which will be described specifically later.

The scorotron charger 303 uniformly charges the surface of the drum 301 being rotated to, e.g., negative polarity. The scorotron charger 303 may be replaced with a corotron charger, if desired. Alternatively, use may be made of a charge bias member contacting the surface of the drum 1 and applied with a bias for charging.

The exposing device 304 scans the uniformly charged surface of the drum 301 with light derived from image data of one of four colors for thereby forming a latent image on the above surface. While the exposing device 304 is implemented as an LED (Light Emitting Diode) array and focusing devices in the illustrative embodiment, use may be made a laser scanning system configured to scan the drum 301 with a light beam modulated in accordance with image data by using a laser, a polygonal mirror and so forth.

The developing unit 305 develops the latent image formed on the drum 201 with a two-ingredient type developer made up of toner grains and magnetic carrier grains. In the developing unit 305, two screws 305*c* convey the developer toward the rear end, as viewed in the direction perpendicular to the sheet surface of FIG. 17, while agitating it. The two screws 305*c* convey the developer in opposite directions to each other. For example, the left screw 305*c* conveys the developer from the front toward the rear in the above direction while the right screw 305*c* conveys it from the rear toward the front in the above direction. The developer conveyed to the rear end of the developing unit 5 by the left screw 305*c* is handed over to the right screw 305*c*. The right screw 305*c* then conveys the developer toward the front while causing part of the developer to deposit on a developing roller 305*b*, which will be described later specifically. The developer not deposited on the developing roller 305*b* or returned from the roller 305*b* to the right screw 305*c* is handed over to the left screw 305*c*. In this manner, the developer is circulated in the developing unit 305. If desired, the two-ingredient type developer may be replaced with a single-ingredient type developer not containing carrier grains, i.e., toner only.

The developing roller 305*a* is made up of a rotatable sleeve and a stationary magnet roller disposed in the sleeve. The sleeve is implemented by a hollow cylinder formed of stainless steel, aluminum or similar nonmagnetic metal and rotated counterclockwise, as viewed in FIG. 17, by drive means not shown. The magnet roller has a plurality of magnetic poles divided in the circumferential direction thereof. The developer being conveyed by the right screw 305*c* is attracted by the magnetic force of the magnet roller and scooped up onto the sleeve thereby. The developer is conveyed by the sleeve, which is in rotation, toward a developing zone where the sleeve faces the drum 301, while being metered by a doctor blade 305*b*. More specifically, the doctor blade 305*b* adjoins, but does not contact, the surface of the sleeve in order to regulate the thickness of the developer deposited on the sleeve in the form of a layer.

In the developing zone, the latent image formed on the drum 301 by the procedure stated earlier is brought into sliding contact with the developer deposited on the sleeve. As a result, the toner contained in the developer and chargeable to negative polarity, which is the same as the polarity of the latent image, is deposited on the latent image, producing a corresponding toner image in yellow, magenta, cyan or black. In this manner, negative-to-positive development is effected in the first toner image forming section 380.

For the toner, use is made of spherical or amorphous toner grains produced by any conventional method. The toner grains have a volume mean grain size of 20 μm or below, preferably between 10 μm and 4 μm. Carrier grains, also produced by any conventional method, should preferably have a volume mean gain size ranging from about 25 μm to about 60 μm.

The developer, lost the toner in the developing zone, is returned to the developing unit 305 in accordance with the rotation of the sleeve. This part of the developer is then released from the sleeve by a repulsive magnetic field formed by nearby magnetic poles of the magnet roller, which are of the same polarity, returned to the right screw 305*c* and then handed over to the left screw 305*c*.

The toner content sensor 305*e* is positioned below the left screw 305*c* and senses the permeability of the developer being conveyed by the left screw 305*c*.

A controller, not shown, determines whether or not the toner content of the developer is smaller than a preselected threshold on the basis of the output signal of the toner content sensor 305*e*. If the answer of this decision is positive, then the controller drives one of eight toner replenishing means, not shown, associated with the above developer for a preselected period of time. The eight toner replenishing means mentioned above each correspond to the developing unit of any one of the four first toner image forming sections 380A through 380K and four second toner image forming sections 381Y through 381K and is connected to any one of four toner bottles 386Y through 386K, FIG. 16. The toner bottles 386Y through 386K are removably mounted to a bottle storing section 385 located on the top of the printer 300A.

In the above configuration, fresh tone of preselected color is replenished from the designated toner bottle to the left screw 305*c* so as to recover the toner content of the developer. Such toner replenishing means should preferably be implemented by a conventional powder pump that sucks toner from a toner bottle and conveys it to a developing unit. This reduces limitations on the positions of the toner bottles and therefore contributes to the efficient allocation of a limited space available in the printer 300A. In addition, because toner can be replenished at adequate timing, the developing unit 305 does not have to be provided with a great toner storing space and is therefore small size.

Figure 18:
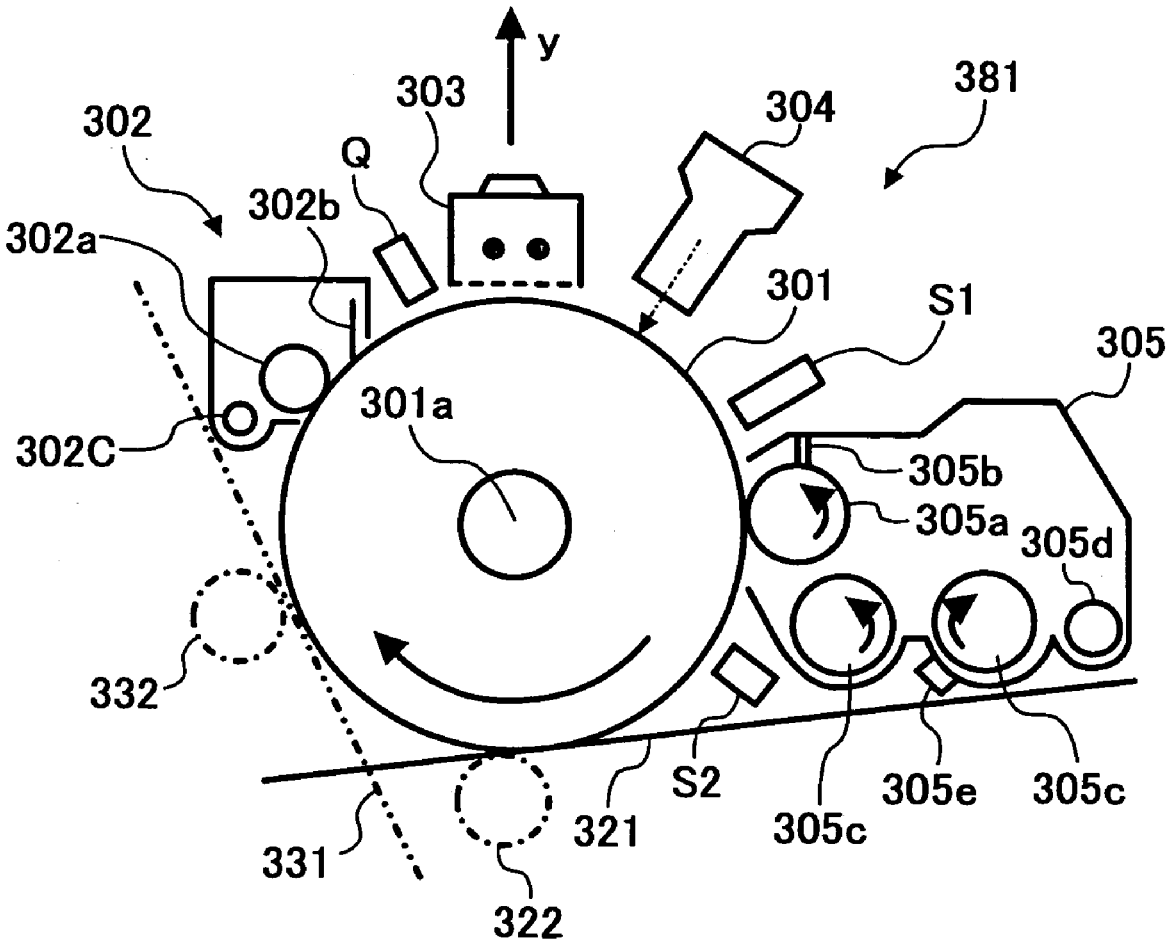
FIG. 18 is an enlarged view showing one of second toner image forming sections also included in the third embodiment.

FIG. 18 shows one of the second toner image forming sections 381Y through 381K in an enlarged view. Because the second toner image forming sections 380Y through 380K are also substantially identical in configuration except for the color of toner to use, the suffix Y, M C or K attached to the reference numeral 381 is omitted. As shown, the second toner image forming section 381 is identical with the first toner image forming section 380, FIG. 17, except for the direction in which the drum 301 is rotated. It is noteworthy that the first and second toner image forming sections 380 and 381 are symmetric to each other with respect to a y axis extending through the axis 201*a* of the drum 301. This arrangement is significant although it is dependent on the arrangement of members around the drum 301. More specifically, in the illustrative embodiment, consideration is given to portions connected to the printer body, e.g., portions connected to drive means, electric connecting portions, and the connection of toner replenishing portions and toner discharging portions, so that the first toner image forming portions 380Y through 380K and second toner image forming portions 381Y through 381K are replaceable with each other. It is therefore not necessary to produce particular developing devices, belt cleaners and parts for each of the first and second toner image forming sections. This enhances efficient production and management of parts for thereby reducing the overall cost of the printer.

Referring again to FIG. 16, the printer 300A includes a duplex image transferring device made up of the first and second image transferring units or devices 320 and 330. In the first image transferring unit 320, the first belt 321 is passed over a plurality of rollers 323, 324, 325 and 326, 327, 328 and 329 and held in contact with the drums 301Y through 2301K of the first toner image forming sections 380Y through 380K. In this condition, the first belt 321 and drums 301Y through 301K form consecutive Y, M, C and K primary image transfer nips for sequentially transferring a Y, an M, a C and a K toner image to the belt 321 one above the other. The first belt 321 endlessly turns clockwise, as viewed in FIG. 16. At each primary image transfer nip, one of four primary image transfer rollers 322 applied with a primary image transfer bias from a power supply, not shown, nips the first belt 321 between it and associated one of the drums 301Y through 301K. In this configuration, the Y, M, C or K toner image is transferred to the first belt 321 at each nip by the primary image transfer bias and nip pressure.

A belt cleaner 320A adjoins the outer surface of the first belt 321 and faces the roller 323, which plays the role of a first cleaning backup roller. The belt cleaner 310A scrapes off toners, paper dust and other impurities left on the first belt 321 moved away from the consecutive primary image transfer nips. The members associated with the first belt 321 are constructed integrally with the first image forming section 320 removable from the printer 300A.

On the other hand, the second image transferring unit 330 includes the second belt 331 passed over rollers 333, 334, 335 and 336 and held in contact with the drums 301Y through 301K. In the second image transferring unit 330, the second belt 331 form a Y, an M, a C and a K primary image transfer nips for sequentially transferring a Y, an M, a C and a K toner image from the drums 301Y through 301K to the belt 331 one above the other. The second belt 331 endlessly moves counterclockwise, as viewed in FIG. 16. At each primary image transfer nip, one of four primary image transfer rollers 332 applied with a primary image transfer bias from a power supply, not shown, nips the second belt 331 between it and associated one of the drums 301Y through 301K. In this configuration, the Y, M, C or K toner image is transferred to the second belt 331 at each nip by the primary image transfer bias and nip pressure.

A belt cleaner 330A adjoins the outer surface of the second belt 331 and faces the roller 333, which plays the role of a first cleaning backup roller. The belt cleaner 330A scrapes off toners, paper dust and other impurities left on the second belt 331 moved away from the consecutive primary image transfer nips. The members associated with the first belt 331 are also constructed integrally with the second image forming section 330 removable from the printer 300A.

The four primary image transfer rollers or image transferring means 322 and 332 included in the first and second belt units, respectively, each may be constituted by a metallic core and a conductive rubber layer formed on the core, in which case a bias is applied to the core from a power supply not shown. In the illustrative embodiment, conductive rubber is implemented by carbon-dispersed urethane rubber whose volume resistance is controlled to about $10^5$ Ωcm.

In a monochrome mode also available with the printer 300A and using only K toner, the toner image forming sections 380Y, 380M and 380C of the first belt unit are not operated. Further, a mechanism is provided for releasing the toner image forming sections 380Y, 380M and 380C from the first belt 321. More specifically, the roller 326 and primary image transfer rollers 322 are mounted on a frame, not shown, which is angularly movable about a given point. When the frame is moved away from the drums, only the drum 301K is held in contact with the first belt 321. In this condition, a monochromatic image is formed by black toner. Such a configuration is successful to extend the life of the drums. This is also true with the toner image forming sections 381Y, 381M and 381C included in the second belt unit.

A secondary image transfer roller or image transferring means 346 adjoins the outer surface of the first belt 321 in the vicinity of the support roller 328. The secondary image transfer roller 346 and support roller 328 nip the second belt 321 to thereby form a secondary image transfer nip. The image transfer roller 346 is made up of a metallic core and a conductive rubber covering the core. A secondary image transfer bias is applied to the core from a power supply not shown. The conductive rubber has volume resistance controlled to $10^7$ Ωcm or so by carbon dispersed therein.

A registration roller pair 345 is positioned at the right-hand side of the secondary image transfer nip, as viewed in FIG. 16. The registration roller pair 345 nips a sheet conveyed from the sheet feeder 340, which will be described later, once stops rotating, and then conveys the sheet toward the secondary image transfer nip such that the sheet meets a four-color toner image carried on the first belt 321. At the secondary image transfer nip, the four-color toner image is brought into contact with one or first surface of the sheet facing upward, as viewed in FIG. 16. At this time, the four-color toner image is transferred from the first belt 321 to the first surface of the sheet by the secondary image transfer bias and nip pressure.

The sheet, moved away from the secondary image transfer nip, is separated from the first belt 321 and then handed over to the upper portion of the second belt 331. A conventional image transfer charger 347 is positioned above the upper portion of the second belt 331 and spaced from the belt 331 by a preselected gap. The gap between the image transfer charger 347 and the second belt 331 forms an image transfer position for transferring a four-color toner image from the second belt 331 to the other surface or second surface of the sheet facing downward, as viewed in FIG. 16. The image transfer charger 347 includes a discharge electrode implemented by a thin tungsten or gold wire and a casing holding it. An image transfer current is fed from a power supply, not shown, to the discharge electrode. When the sheet P is being conveyed between the second belt 331 and the image transfer charger 347, the image transfer charger 347 applies a charge to the first surface of the sheet P for thereby transferring a four-color toner image from the second belt 331 to the second surface of the sheet P. It is to be noted that the secondary image transfer bias and the charge applied by the image transfer charger 347 both are of positive polarity opposite to negative polarity deposited on the toner.

The sheet feeder 340, located at the right-hand side of the printer 300A, includes a sheet tray 340*a* storing a great amount of sheets and three sheet cassettes 340*b*, 340*c* and 340*d* arranged one above the other by way of example. The sheet tray 340*a* and sheet cassettes 340*b* through 340*d* each are capable of being pulled out toward the front or operation side in the direction perpendicular to the sheet surface of FIG. 16. The sheet tray 340*a* and sheet cassettes 340*b* through 340*d* each are loaded with a particular kind of sheets. Pickup and separation means 341A through 341D each pay out only the top sheet from the sheet tray 340*a* or one of the sheet cassettes 340*b* through 340*d* associated therewith while surely separating it from the other sheets underlying it. The sheet thus paid out is conveyed to sheet paths 343B and 343A.

The registration roller pair 345 stated earlier and a lateral registration correcting mechanism 344 are positioned on the sheet path 343A. The lateral registration correcting mechanism 344 is configured to control the position of the sheet in the direction perpendicular to the direction of conveyance. This mechanism 344 may include a lateral reference guide and a skew roller, not shown, and slide the sheet such that one edge of the sheet abuts against the reference guide. The reference guide is movable to a position matching with the size of the sheet to be used. Alternatively, the mechanism 344 may be implemented as a jogger system using jogger members that press opposite edges of the sheet a plurality of times for a short period of time.

The sheet is conveyed toward the secondary image transfer nip or third image transfer position where the first belt 321 and secondary image transfer roller 346 contact each other.

Roller pairs 342C are arranged on a sheet path 343C. Another sheet feeder 300C may be positioned upstream of the sheet path 343C in the direction of sheet feed, as desired. The top of the sheet tray 340*a* is positioned such that the top sheet, paid out from the sheet tray 340*a*, is conveyed substantially horizontally without being bent. Therefore, even relatively thick or rigid sheets can be fed from the sheet tray 340*a*. To insure the feed of various kinds of sheets, a vacuum mechanism for feeding sheets with air should preferably be applied to the sheet tray 340*a*. Sheet sensors, not shown, are arranged on the various sheet paths to implement triggers for various signals.

A sheet conveyor 350 is arranged at the left-hand side, as viewed in FIG. 16, of the second belt unit included in the second image transferring unit 330. A fixing unit or device 360, including heating means, is positioned at the left-hand side of the sheet conveyor 350, as viewed in FIG. 16. The heating means may be implemented as a heater disposed in a roller, an endless belt to be heated or induction heating. The roller or the belt is uniform in material, hardness and surface property in order to uniform the tonality and gloss of images to be formed on opposite surfaces of a sheet. Further, control means, not shown, controls fixing conditions in accordance with the full-color/monochrome mode or the simplex/duplex mode and establishes fixing conditions optimum for the kind of sheets to be used. A cooling roller pair 370 is positioned downstream of the fixing unit 360 in the direction of sheet conveyance in order to cool off a sheet coming out of the fixing unit 360, thereby rapidly stabilizing the unstable toner on the sheet. For the cooling roller pair 370, use may be made of a heat pipe structure including a heat radiating portion. The sheet thus cooled off is driven out to a stack portion 375, which is mounted on the left-hand side of the printer 300A, by an outlet roller pair 371. The stack portion 375 includes a tray driven by an elevator mechanism, not shown, to move in the up-and-down direction in accordance with the stack level, so that a great amount of sheets can be stacked on the tray. The sheet may be routed to another sheet finisher, e.g., a puncher or a stapler via the stack portion 375, if desired.

The toner bottles 386Y through 386K, each storing fresh toner of a particular color, are removably mounted on the bottle storing section 385, as stated earlier. The bottle storing section 385 is positioned at the rear portion of the top of the printer 300A, as viewed in the direction perpendicular to the sheet surface of FIG. 16, so that the front portion of the same can be used as a flat work table. In the illustrative embodiment, the developing units of the first and second image forming sections 320 and 330 using toner of the same color are configured to share one of the toner bottles 386Y through 386K in the illustrative embodiment although they may be provided with respective tone bottles. Further, the toner bottle 386K, storing black toner usually consumed more than the other toners, may be sized greater than the other toner bottles 386Y, 386M and 386C.

The operation and display unit 390 is mounted on the top of the printer 300A and includes, e.g., a keyboard to allow the operator of the printer to input desired image forming conditions. The operation and display unit 390 may further include a display capable of displaying various kinds of information to thereby facilitate information exchange between the operator and the printer 300A.

A waste toner tank 387 is disposed in the printer 300A and connected to the drum cleaners 302, belt cleaners 320A and 330A and a belt cleaner 350A, which is included in the sheet conveyor 350, and stores waste toners, paper dust and other impurities collected from such cleaners. This is successful to reduce the size of each cleaner while facilitating the disposal of the waste toners collected in the tank 387. A full sensor, not shown, is used to urge the operator to empty or replace the waste toner tank 387.

A control unit 395, also disposed in the printer 300A, includes various power supplies and a control board arranged in and protected by a metallic frame. A fan 396 is mounted on the printer 396 in order to cope with heat generated by the fixing unit 360 and various electric units. Also, the fan 396 is connected to the heat radiating portion of the cooling roller pair 379 so as to insure the cooling effect available therewith.

The ADF 300B is mounted on the top of the sheet feeder 340 in order to read a document while automatically conveying it with a conventional technology. Information read from the document by the ADF 300B is sent to the control unit 395, so that the control unit 395 controls the printer 300A in accordance with the information received for thereby outputting an image identical with the image of the document. Alternatively, a personal computer or even a telephone circuit, for example, may be connected to the printer 300A and send image information to the printer 300A.

A full-color, simplex print mode available with the printer 300A will be described hereinafter. Basically, the illustrative embodiment allows either one of two different simplex printing methods to be selected, i.e., one that transfers a four-color toner image formed on the first belt 321 to the first surface of a sheet by secondary image transfer and the other that transfers a four-color toner image transferred to the second belt 331 to the second surface of a sheet by secondary image transfer. When image data extend over a plurality of pages, it is preferable to so control the image forming order as to stack prints on the stack portion 375 in order of page. In light of this, the former method stated above, capable of sequentially printing image data of the last page first, will be described hereinafter.

When the printer 300A is driven, the first belt 321 and the drums 301Y through 301K of the first toner image forming sections 380Y through 380K start rotating. At the same time, the second belt 331 starts turning, but the drums 301Y through 301K of the second toner image forming sections 381Y through 381K are released from the second belt 331 and held stationary. In this condition, in the first toner image forming section 380Y, the exposing device 304 scans the surface of the drum 301Y uniformly charged by the charger 303 with light derived from yellow image data, thereby forming a latent image on the above surface.

Subsequently, the developing unit of the first toner image forming section 381Y develops the latent image formed by the exposing device 304 to thereby produce a Y toner image. The Y toner image thus produced is electrostatically transferred from the drum 301Y to the first belt 321 by primary image transfer. Such a sequence, consisting of latent image formation, development and primary image transfer, is executed with the other drums 301M, 301C and 301K also at preselected timing. The resulting M, C and K toner images are sequentially transferred to the first belt 321 over the Y toner image at the consecutive primary image transfer nips, completing a four-color toner image on the belt 321.

In the sheet feeder 340, one of the sheet feeding and separating means 341A through 341D pays out a sheet matching with the image data from associated one of the sheet tray 340*a* and sheet cassettes 340*b*. The sheet thus paid out is conveyed to the lateral registration correcting mechanism 344 located on the sheet path 343C of the printer 300A by roller pairs 342B and 342C. The lateral registration correcting mechanism 344 corrects the position of the sheet being conveyed from the sheet feeder or recording medium feeding means 340 toward the duplex image transferring device made up of the first and second image transferring units, as stated earlier. In the illustrative embodiment, the mechanism 344 includes a pair of guide plates are movable in the direction perpendicular to the direction of sheet feed, so that the distance between the guide plates is matched to the width of the sheet.

The sheet corrected in position by the lateral registration correcting mechanism 344 is stopped by the registration roller pair 345 and then driven thereby to the secondary image transfer nip at preselected timing. At the secondary image transfer nip, the four-color toner image carried on the first belt 321 is transferred to the first surface of the sheet by secondary image transfer. The outer surface of the first belt 321 moved away from the secondary image transfer nip is cleaned by the belt cleaner 320A.

As shown in FIG. 18, in each of the first toner image forming sections 380Y through 380K, the drum cleaner 302 removes toner and impurities left on the surfaces of the drum 301 moved away from the primary image transfer nip. In the illustrative embodiment, the drum cleaner 302 uses a brush, blade or similar cleaning member for the above purpose, as stated previously. The toner and impurities removed from the drum 301 are collected in the waste toner tank 387 by collecting means not shown. It is to be noted that the sensors S1 and S2 adjoining each drum 301 are respectively responsive to the surface potential of the drum 301 after exposure and the amount of toner deposited on the drum 301 after development. On receiving such information from the sensors S1 and S2, the control means sets adequate image forming conditions. The quenching lamp Q discharges the charge left on the surface of the drum 301 cleaned by the drum cleaner 302.

In FIG. 16, the sheet, carrying the four-color toner image on its first surface, is handed over to the second belt 331 of the second image transferring unit and then conveyed by the sheet conveyor or sheet conveying device 350 to the fixing unit 360. The discharge and separation charger 358 charges the sheet before the sheet is handed over to the fixing unit 360, facilitating the separation of the sheet electrostatically adhered to the belt 351.

In the fixing unit 360, the toners of different colors, forming the full-color image on the first surface of the sheet, are melted and mixed by heat. The sheet, carrying toners only on its first surface, needs less thermal energy for fixation than a sheet carrying toners on both surfaces thereof, i.e., a duplex print. The control unit 395 optimally controls power to be used by the fixing unit 360 in accordance with the image. Before the toners on the sheet are fully fixed to the sheet, they are rubbed by guide members on the sheet path and lost or disturbed thereby. To solve this problem, the cooling roller pair or cooling means 370 cools off the sheet coming out of the fixing unit 360 for thereby fully fixing the toners to the sheet. Subsequently, the outlet roller pair 371 conveys the sheet or simplex print to the stack portion 375.

In the illustrative embodiment, the image forming sequence is so programmed as to stack consecutive prints on the stack portion 375 in the incrementing order as to page. The stack portion 375 is lowered little by little in accordance with the number of prints sequentially stacked thereon, so that the prints can be neatly stacked in order of page. Alternatively, consecutive prints may be punched or delivered to a sorter, collator, stapler, folder or similar sheet finisher, if desired.

The other simplex image forming method mentioned earlier is essentially identical with the method described above except that the first toner image forming sections 380Y through 380K do not form images and that an image with the smallest page number is formed first, and will not be described specifically in order to avoid redundancy.

Next, a full-color, duplex print mode also available with the illustrative embodiment will be described hereinafter. When an image signal is input to the printer 300A, a Y, an M, a C and a K toner image are respectively formed on the drums 301Y through 301K of the first toner image forming sections 380Y through 380K, respectively, in the same manner as in the simplex print mode. The Y, M, C and K toner images are sequentially transferred to the first belt 321 one above the other at the consecutive primary image transfer nips. Substantially in parallel with such image formation, Y, M, C and K toner images are formed on the drums 301Y through 301K of the second toner image forming sections 381Y through 381K, respectively, and then transferred to the second belt 331 one above the other at the consecutive primary image transfer nips. In this manner, four-color toner images are formed on both of the first and second belts 321 and 331.

In the illustrative embodiment, the distance between nearby ones of the second toner image forming sections 381Y through 381K is smaller than the distance between nearby ones of the first toner image forming sections 380Y through 380K. Therefore, the primary image transfer completes earlier in the second image transferring unit than in the first image transferring unit.

After the four-color toner image formed on the first belt 321 has been transferred to the first surface of the sheet conveyed by the registration roller pair 345 to the secondary image transfer nip, the sheet is handed over to the second belt 331. Subsequently, at the fourth image transfer position where the second belt 331 and image transfer charger 347 face each other at a preselected distance, the four-color toner image formed on the second belt 331 is transferred to the second surface of the same sheet.

The sheet, thus carrying the full-color images on both surfaces thereof, is brought to the sheet conveyor 350. The sheet conveyor 350 includes a belt device made up of the belt member 351 and a plurality of support rollers supporting the belt member 351. The support rollers comprise an inlet roller 352, a separation roller 354, a cleaning backup roller 355, and a tension roller 356. The sheet conveyor 350 additionally includes the belt cleaner 350A, the separation charger 358, drive means and so forth. The drive means rotates the cleaning backup roller 355 to thereby cause the belt member 351 to turn counterclockwise, as viewed in FIG. 16. The sheet, handed over from the secondary image transferring unit 330 to the sheet conveyor 350, is conveyed by the belt member 351 toward the fixing unit 360. The sheet is then separated from the surface of the belt member 351 at the position of the separation roller 354. At this instant, the separation charger 358 charges the sheet in order to promote the separation of the sheet. Thereafter, the toner images carried on the sheet are fixed by heat and pressure in the fixing unit 360. Finally, the sheet is driven out to the stack portion 375 via the cooling roller pair 370 and outlet roller pair 371.

When image data extend over a plurality of pages, the image forming sequence is so controlled as sequentially stack consecutive sheets with images with smaller page numbers facing downward. Consequently, the prints are successfully arranged in order of page when picked up from the stack portion 375 and then turned upside down. More specifically, the first and second pages appear on the front and back of the first print, respectively, the third and fourth pages appear on the front and back of the second print, respectively, and so forth. The control unit 395 performs such control over the image forming sequence as well as control for applying greater power to be applied to the fixing unit 360 in the duplex mode than in the simplex mode.

While the foregoing description has concentrated on the simplex and duplex full-color print modes, the present invention is, of course, operable in a simplex and a duplex monochromatic print mode, as desired. An openable cover, not shown, is mounted on the printer 300A and can be opened in the event of maintenance or the replacement of parts.

Arrangements unique to the printer of the image forming system of the illustrative embodiment will be described hereinafter. The support rollers included in the belt devices of the first and second image transferring units 320 and 330 each are provided with a dimension, as measured in the widthwise direction of the belt 321 or 331, smaller than the width of the belt. The belt 321 and 331 each are formed with the irregularities shown in FIG. 7 at a pitch that allows a plurality of projections to abut against the end face of each of all support rollers at the same time. With this configuration, it is possible to prevent the belts 321 and 331 from running off the support rollers associated therewith, compared to a case wherein only a single projection abuts against the end face of a single support roller.

The press rollers 329 and 337, respectively included in the first and second image transferring units 320 and 330, respectively press the outer surfaces of the belts 321 and 331 in such a manner as to inversely bend the belts inward of the belt loop. In this condition, some member can be positioned in the space formed by the resulting concave portion of each belt member 321 or 331, so that free layout around the belt member is enhanced and promotes size reduction of the entire printer. In the illustrative embodiment, the belt cleaners 320A and 330A are respectively partly positioned in the above spaces. It is therefore possible to remove the toner undesirably deposited on the belts 321 and 331 while implementing compact layout.

Dive means, not shown, rotates the cleaning roller 333 of the second image transferring unit 330 for thereby applying a drive force to the second belt 331. The second image transferring unit 330 can therefore reduce the slippage of the second belt 331, compared to a case wherein a cleaning backup roller simply follows the movement of the belt 331.

The press rollers 329 and 337 each are made up of a center portion and projections extending radially outward from opposite ends of the center portion as in the first embodiment, the center portion pressing the outer surface of the belt 321 or 331. It is therefore possible to preventing the belt 321 or 331 from being shifted on the press roller 329 or 337 also. Further, because the center portion and projections are produced separately from each other, it is possible to further enhance free layout and promote efficient mounting of the press rollers 329 and 337. The support rollers of the first and second image transferring units 320 and 330 all are provided with a diameter ranging from 16 mm to 30 mm. The press rollers 329 and 337 each are provided with a diameter of 16 mm to 60 mm.

In the belt device of the sheet conveying device, the support rollers each are provided with a dimension, as measured in the widthwise direction of the belt member 351, smaller than the width of the belt member 351. The belt member 351 is formed with the irregularities shown in FIG. 7 at a pitch that allows a plurality of projections to abut against the end face of each of all support rollers at the same time. With this configuration, it is possible to prevent the belt member 351 from running off the support rollers, compared to a case wherein only a single projection abuts against the end face of a single support roller.

The belt member 351 of the sheet conveyor 350 is mainly driven counterclockwise by the support roller 354, which is, in turn, driven counterclockwise by drive means not shown. However, in the illustrative embodiment, not only the support roller 354 but also the cleaning backup roller 355 is driven by drive means, not shown, so that the belt member 351 is allowed to slip little, compared to a case wherein a cleaning backup roller simply follows the rotation of the belt member 351. All rollers included in the sheet conveyor 350 are provided with a diameter of 16 mm to 30 mm.

In the illustrative embodiments shown and described, the toner image forming sections and image transferring device in combination play the role of image recording means for recording a toner image or visible image on a sheet or recording medium P. The present invention is operable with any other belt member, e.g., a developing belt or a photoconductive belt and is applicable to any other image forming apparatus, e.g., an ink jet recording system.

In summary, in accordance with the present invention, a belt member is protected from deterioration and slippage despite that it is supported in an inversely bent position. More specifically, the top of a rib, protruding from the base of the belt, is positioned more inward of the belt loop than the bottom of the rib, which adjoins the base, and therefore forms a smaller ark than the bottom. Consequently, the circumferential length of the top is smaller than the circumferential length of the bottom. When the belt member is inversely bent, the outer and inner surfaces of the belt member replace each other only at the inversely bent portion with the result that the top of the rib forms a greater arc than the bottom of the same. The top side of the rib is therefore stretched by force only at the inversely bent portion in such a manner as to become greater in circumferential length than the bottom side, causing the rib to be subjected to a heavy load. In light of this, a plurality of cuts, each extending from the top toward the bottom of the rib, are formed in the rib at preselected intervals in the circumferential direction of the belt member. In this configuration, the top side of the rib, stretched in the circumferential direction by the inverse bend, splits at the cuts with the result that gaps are formed between nearby split portions. Such gaps allow the belt member to be inversely bent without the top side of the rib being forcibly stretched and therefore protect the rib from deterioration ascribable to the inversely bent position, which is desirable for the size reduction of an image forming apparatus. Further, the cuts allow the rib to easily bend and therefore prevent the base of the belt member from rising away from a support member for thereby reducing the slippage of the belt member.

Further, in accordance with the present invention, a plurality of irregularities are formed in the rib of the belt member and alternate with each other in the circumferential direction of the belt member. In the event of inverse bend, recesses, forming part of the irregularities, are extended in the circumferential direction of the belt member in such a manner as to increase the distance between nearby projections, which form the other part of the irregularities, at the top side of the rib, allowing the belt member to be inversely bent without the top side of the rib being stretched by force. This allows the rib to easily bend in the inverse direction and protect it from deterioration ascribable to the inverse bend. In addition, the irregularities allow the rib to easily bend and therefore prevent the base of the belt member from rising away from a support member for thereby reducing the slippage of the belt member. On the other hand, when the belt member is wrapped around, e.g., a support roller with a large curvature, the recesses are contracted in the circumferential direction of the belt member in such a manner as to reduce the distance between the projections. The belt member can therefore be wrapped with a large curvature without the top side of the rib being forcibly compressed. Consequently, it is possible to reduce the load to act on the rib and allow the rib to easily bend for thereby reducing the deterioration of the rib and the slippage of the belt member ascribable to the great curvature.

Moreover, in accordance with the present invention, a plurality of bores are formed in the rib and capable of splitting in the circumferential direction of the belt member. The rib can therefore easily deform around the bores when the belt member is wrapped with a great curvature. It follows that the belt member can be wrapped with a large curvature without the rib being compressed or expanded by force. This is also successful to reduce the deterioration of the rib and the slippage of the belt member ascribable to the inverse bend of the belt member, which is desirable for the size reduction of an image forming apparatus.

The recesses of the irregularities formed in the rib are smaller in contact area with, e.g., a support roller than the projections and therefore inferior to the projections as to the deviation preventing function. Therefore, a belt member with a rib having the conventional thickness and formed with a plurality of recesses would fail to exhibit the expected deviation preventing effect although reducing slippage and the deterioration of the rib. However, extended researches and experiments showed that when the thickness of the rib was increased by the size of each recess, i.e., made great enough to implement a contact area comparable with one achievable with a con-recess configuration, there could be realizes a deviation preventing effect equivalent to one achievable with the conventional rib. Even such an increase in the thickness of the rib allowed the belt member to be easily wrapped with a great curvature or inversely bent, as also determined by experiments.

Various modifications will become possible for those skilled in the art after receiving the teachings of the present disclosure without departing from the scope thereof.

What is claimed is:

1. A belt member comprising:

a rib formed on an endless inside surface thereof and extending in a circumferential direction of said belt member for protecting said belt member from deviation; and a plurality of bores formed in said rib at intervals in the circumferential direction, each bore extending in a widthwise direction of the belt member.

2. The belt member as claimed in claim 1, wherein said rib is formed integrally with a base of said belt member.

3. The belt as claimed in claim 1, wherein said rib is formed separately from a base of said belt member.

4. The belt member as claimed in claim 3, a bottom of said rib, affixed to said base of said belt member, is sized greater than a top of said rib in a widthwise direction of said belt member.

5. A belt member comprising:

a rib formed on an endless inside surface and extending in a circumferential direction of said belt member for protecting said belt member from deviation;

a plurality of cuts formed in said rib at intervals in the circumferential direction and each extending from a top toward a bottom of said rib; and a plurality of through bores formed in said rib at intervals in the circumferential direction of said belt member and each extending in a widthwise direction of said belt member, said plurality of though bores each being contiguous with a respective one of said plurality of cuts.

6. The belt member as claimed in claim 5, wherein said rib is formed integrally with a base of said belt member.

7. The belt member as claimed in claim 5, wherein said rib is formed separately from a base of said belt member.

8. The belt member as claimed in claim 7, wherein a bottom of said rib, affixed to said base of said belt member, is sized greater than a top of said rib in a widthwise direction of said belt member.

9. A belt device comprising:

an endless belt member; and a plurality of support members supporting said endless belt member at an inside of said belt member;

said belt member comprising:

a rib formed on an endless inside surface thereof and extending in a circumferential direction of said belt member for protecting said belt member from deviation;

a plurality of cuts formed in said rib at intervals in the circumferential direction and each extending from a top toward a bottom of said rib; and a plurality of through bores formed in said rib at intervals in the circumferential direction of said belt member and each extending in a widthwise direction of said belt member, said plurality of through bores each being contiguous with a respective one of said plurality of cuts.

10. The belt device as claimed in claim 9, further comprising a press roller pressing an outside surface of said belt member to thereby inversely bend said belt member toward an inside of a belt loop.

11. The belt device as claimed in claim 10, wherein said press roller comprises a center portion and end portions positioned at opposite ends of said center portion in an axial direction and projecting radially outward from said center portion, and said center portion presses the outside surface of said belt member.

12. The belt device as claimed in claim 11, wherein said center portion and said end portions are formed separately from each other.

13. A belt device comprising:

an endless belt member; and a plurality of support members supporting said endless belt member at an inside of said belt member;

said belt member comprising:

a rib formed on an endless inside surface thereof and extending in a circumferential direction of said belt member for protecting said belt member from deviation; and a plurality of bores formed in said rib at intervals in the circumferential directions, each bore extending in a widthwise direction of the belt member.

14. A sheet conveying device comprising:

a belt device comprising an endless belt member and a plurality of support members supporting said endless belt member at an inside of said belt member; and a drive means for causing at least one of the plurality of support rollers to rotate for thereby causing said endless belt member to move, whereby a sheet, held on surface of said belt member is conveyed in accordance with a movement of said belt member;

said belt member comprising:

a rib formed on an endless inside surface thereof and extending in a circumferential direction of said belt member for protecting said belt member from deviation;

a plurality of cuts formed in said rib at intervals in the circumferential direction and each extending from a top toward a bottom of said rib; and a plurality of through bores formed in said rib at intervals in the circumferential direction of said belt member and each extending in a widthwise direction of said belt member, said plurality of through bores each being contiguous with a respective one of said plurality of cuts.

15. A sheet conveying device comprising:

a belt device comprising an endless belt member and a plurality of support members supporting said endless belt member at an inside of said belt member; and a drive means for causing at least one of the plurality of support rollers to rotate for thereby causing said endless belt member to move, whereby a sheet, held on surface of said belt member is conveyed in accordance with a movement of said belt member;

said belt member comprising:

a rib formed on an endless inside surface thereof and extending in a circumferential direction of said belt member for protecting said belt member from deviation; and a plurality of bores formed in said rib at intervals in the circumferential direction; each bore extending in a widthwise direction of the belt member.

16. A fixing device comprising:

a belt device comprising an endless belt member and a plurality of support members supporting said endless belt member at an inside of said belt member; and drive means for rotating at least one of said plurality of support members to thereby cause said belt member to move;

heating means for heating said belt member; and a contact roller contacting an outside surface of said belt member, whereby a recording medium, carrying a toner image on a surface thereof, is nipped between said belt member and said contact roller to have said toner image fixed on said surface;

said belt member comprising:

a rib formed on an endless inside surface thereof and extending in a circumferential direction of said belt member for protecting said belt member from deviation;

a plurality of cuts formed in said rib at intervals in the circumferential direction and each extending from a top toward a bottom of said rib; and a plurality of through bores formed in said rib at intervals in the circumferential direction of said belt member and each extending in a widthwise direction of said belt member, said plurality of through bores each being contiguous with a respective one of said plurality of cuts.

17. A fixing device comprising:

a belt device comprising an endless belt member and a plurality of support members supporting said endless belt member at an inside of said belt member; and drive means for rotating at least one of said plurality of support members to thereby cause said belt member to move;

heating means for heating said belt member; and a contact roller contacting an outside surface of said belt member, whereby a recording medium, carrying a toner image on a surface thereof, is nipped between said belt member and said contact roller to have said toner image fixed on said surface;

said belt member comprising:

a rib formed on an endless inside surface thereof and extending in a circumferential direction of said belt member for protecting said belt member from deviation; and a plurality of bores formed in said rib at intervals in the circumferential directions, each bore extending in a widthwise direction of the belt member.

18. An image transferring device comprising:

a belt device comprising an endless belt member and a plurality of support members supporting said endless belt member at an inside of said belt member;

drive means for rotating at least one of said support members to thereby cause said belt member to move; and image transferring means for transferring a toner image formed on an image carrier, which faces an outside surface of said belt member, from said image carrier to said belt member or a recording medium held on a surface of said belt member;

said belt member comprising:

a rib formed on an endless inside surface thereof and extending in a circumferential direction of said belt member for protecting said belt member from deviation;

a plurality of cuts formed in said rib at intervals in the circumferential direction and each extending from a top toward a bottom of said rib; and a plurality of through bores formed in said rib at intervals in the circumferential direction of said belt member and each extending in a widthwise direction of said belt member, said plurality of through bores each being contiguous with a respective one of said plurality of cuts.

19. An image transferring device comprising:

a belt device comprising an endless belt member and a plurality of support members supporting said endless belt member at an inside of said belt member;

drive means for rotating at least one of said support members to thereby cause said belt member to move; and image transferring means for transferring a toner image formed on an image carrier, which faces an outside surface of said belt member, from said image carrier to said belt member or a recording medium held on a surface of said belt member;

said belt member comprising:

a rib formed on an endless inside surface thereof and extending in a circumferential direction of said belt member for protecting said belt member from deviation; and a plurality of bores formed in said rib at intervals in the circumferential directions, each bore extending in a widthwise direction of the belt member.

20. An image transferring device comprising:

a belt device comprising an endless belt member and a plurality of support members supporting said endless belt member at an inside of said belt member;

drive means for rotating at least one of said support members to thereby cause said belt member to move; and image transferring means for transferring a toner image carried on an outside surface of said belt member to a recording medium contacting said outside surface of said belt member;

said belt member comprising:

a rib formed on an endless inside surface thereof and extending in a circumferential direction of said belt member for protecting said belt member from deviation;

a plurality of cuts formed in said rib at intervals in the circumferential direction and each extending from a top toward a bottom of said rib; and a plurality of through bores formed in said rib at intervals in the circumferential direction of said belt member and each extending in a widthwise direction of said belt member, said plurality of through bores each being contiguous with a respective one of said plurality of cuts.

21. An image transferring device comprising:

a belt device comprising an endless belt member and a plurality of support members supporting said endless belt member at an inside of said belt member;

drive means for rotating at least one of said support members to thereby cause said belt member to move; and image transferring means for transferring a toner image carried on an outside surface of said belt member to a recording medium contacting said outside surface of said belt member;

said belt member comprising:

a rib formed on an endless inside surface thereof and extending in a circumferential direction of said belt member for protecting said belt member from deviation; and a plurality of bores formed in said rib at intervals in the circumferential direction, each bore extending in a widthwise direction of the belt member.

22. A duplex image transferring device for transferring toner images carried on a surface of first and second endless belt members to opposite surfaces of a recording medium, said duplex image transferring device comprising:

a first image transferring device comprising:

a first belt device comprising the first endless belt member and a first plurality of support members supporting said first endless belt member at an inside of said first belt member;

drive means for rotating at least one of said first support members to thereby cause said first belt member to move; and image transferring means for transferring a toner image formed on an image carrier, which faces an outside surface of said first belt member, from said image carrier to said first belt member or a recording medium held on a surface of said first belt member;

a second image transferring device comprising:

a second belt device comprising the second endless belt member and a second plurality of support members supporting said second endless belt member at an inside of said second belt member;

drive means for rotating at least one of said second support members to thereby cause said second belt member to move; and image transferring means for transferring a toner image carried on an outside surface of said second belt member to a recording medium contacting said outside surface of said second belt member;

said first or second belt member comprising:

a rib formed on an endless inside surface thereof and extending in a circumferential direction of said first or second belt member for protecting said first or second belt member from deviation;

a plurality of cuts formed in said rib at intervals in the circumferential direction and each extending from a top toward a bottom of said rib; and a plurality of through bores formed in said rib at intervals in the circumferential direction of said belt member and each extending in a widthwise direction of said belt member, said plurality of through bores each being continuous with a respective one of said plurality of cuts;

wherein a toner image is transferred from said first belt member of said first image transferring device to one surface of a recording medium while a toner image is transferred from said second belt member of said second image transferring device to the other surface of said recording medium.

23. A duplex image transferring device for transferring toner images carried on a surface of first and second endless belt member to opposite surfaces of a recording medium, said duplex image transferring device comprising:

a first image transferring device comprising:

a first belt device comprising the first endless belt member and a first plurality of support members supporting said first endless belt member at an inside of said first belt member;

drive means for rotating at least one of said first support members to thereby cause said first belt member to move; and image transferring means for transferring a toner image formed on an image carrier, which faces an outside surface of said first belt member, from said image carrier to said first belt member or a recording medium held on a surface of said first belt member;

a second image transferring device comprising:

a second belt device comprising the second endless belt member and a second plurality of support members supporting said second endless belt member at an inside of said second belt member;

drive means for rotating at least one of said second support members to thereby cause said second belt member to move; and image transferring means for transferring a toner image carried on an outside surface of said second belt member to a recording medium contacting said outside surface of said second belt member;

said first or second belt member comprising:

a rib formed on an endless inside surface thereof and extending in a circumferential direction of said first or second belt member for protecting said first or second belt member from deviation; and a plurality of bores formed in said rib at intervals in the circumferential directions, each bore extending in a widthwise direction of the belt member;

wherein a toner image is transferred from said first belt member of said first image transferring device to one surface of a recording medium while a toner image is transferred from said second belt member of said second image transferring device to the other surface of said recording medium.

24. An image forming apparatus comprising:

image recording means for recording a visible image on a surface of a sheet; and sheet conveying means for conveying the sheet;

said sheet conveying means comprising:

a belt device comprising an endless belt member and a plurality of support members supporting said endless belt member at an inside of said belt member; and a drive means for causing at least one of the plurality of support members to rotate for thereby causing said endless belt member to move, whereby a sheet, held on surface of said belt member is conveyed in accordance with a movement of said belt member;

said belt member comprising:

a rib formed on an endless inside surface thereof and extending in a circumferential direction of said belt member for protecting said belt member from deviation;

a plurality of cuts formed in said rib at intervals in the circumferential direction and each extending from a top toward a bottom of said rib; and a plurality of through bores formed in said rib at intervals in the circumferential direction of said belt member and each extending in a widthwise direction of said belt member, said plurality of through bores each being contiguous with a respective one of said plurality of cuts.

25. The apparatus as claimed in claim 24, wherein the plurality of support rollers each have a diameter ranging from 16 mm to 30 mm.

26. An image forming apparatus comprising:

image recording means for recording a visible image on a surface of a sheet; and sheet conveying means for conveying the sheet;

said sheet conveying means comprising:

a belt device comprising an endless belt member and a plurality of support members supporting said endless belt member at an inside of said belt member; and a drive means for causing at least one of the plurality of support members to rotate for thereby causing said endless belt member to move, whereby a sheet, held on surface of said belt member is conveyed in accordance with a movement of said belt member;

said belt member comprising:

a rib formed on an endless inside surface thereof and extending in a circumferential direction of said belt member for protecting said belt member from deviation; and a plurality of bores formed in said rib at intervals in the circumferential direction, each bore extending in a widthwise direction of the belt member.

27. In an image forming apparatus including image recording means for recording a toner image on a surface of a recording medium and fixing means for fixing said toner image on said surface, said fixing means comprising:

a belt device comprising an endless belt member and a plurality of support members supporting said endless belt member at an inside of said belt member; and drive means for rotating at least one of said plurality of support members to thereby cause said belt member to move;

heating means for heating said belt member; and a contact roller contacting an outside surface of said belt member, whereby a recording medium, carrying a toner image on a surface thereof, is nipped between said belt member and said contact roller to have said toner image fixed on said surface;

said belt member comprising:

a rib formed on an endless inside surface thereof and extending in a circumferential direction of said belt member for protecting said belt member from deviation;

a plurality of cuts formed in said rib at intervals in the circumferential direction and each extending from a top toward a bottom of said rib; and a plurality of through bores formed in said rib at intervals in the circumferential direction of said belt member and each extending in a widthwise direction of said belt member, said plurality of through bores each being contiguous with a respective one of said plurality of cuts.

28. The apparatus as claimed in claim 27, wherein the plurality of support rollers each have a diameter ranging from 16 mm to 30 mm.

29. In an image forming apparatus including image recording means for recording a toner image on a surface of a recording medium and fixing means for fixing said toner image on said surface, said fixing means comprising:

a belt device comprising an endless belt member and a plurality of support members supporting said endless belt member at an inside of said belt member; and drive means for rotating at least one of said plurality of support members to thereby cause said belt member to move;

heating means for heating said belt member; and a contact roller contacting an outside surface of said belt member, whereby a recording medium, carrying a toner image on a surface thereof, is nipped between said belt member and said contact roller to have said toner image fixed on said surface;

said belt member comprising:

a rib formed on an endless inside surface thereof and extending in a circumferential direction of said belt member for protecting said belt member from deviation; and a plurality of bores formed in said rib at intervals in the circumferential direction, each bore extending in a widthwise direction of the belt member.

30. In an image forming apparatus including an image carrier for carrying a toner image and image transferring means for transferring said toner image from said image carrier to either one of an endless belt member and a recording medium held on a surface of said endless belt member, said image transferring means comprising:

a belt device comprising an endless belt member and a plurality of support members supporting said endless belt member at an inside of said belt member;

drive means for rotating at least one of said support members to thereby cause said belt member to move; and image transferring means for transferring a toner image formed on an image carrier, which faces an outside surface of said belt member, from said image carrier to said belt member or a recording medium held on a surface of said belt member;

said belt member comprising:

a rib formed on an endless inside surface thereof and extending in a circumferential direction of said belt member for protecting said belt member from deviation;

a plurality of cuts formed in said rib at intervals in the circumferential direction and each extending from a top toward a bottom of said rib; and a plurality of through bores formed in said rib at intervals in the circumferential direction of said belt member and each extending in a widthwise direction of said belt member, said plurality of through bores each being contiguous with a respective one of said plurality of cuts.

31. The apparatus as claimed in claim 30, wherein said belt device comprises a press roller pressing an outside surface of said belt member to thereby inversely bend said belt member toward an inside of a belt loop.

32. The apparatus as claimed in claim 31, wherein said press roller comprises a center portion and end portions positioned at opposite ends of said center portion in an axial direction and projecting radially outward from said center portion, and in that said center portion presses the outside surface of said belt member.

33. The apparatus as claimed in claim 32, wherein said center portion and said end portions are formed separately from each other.

34. The apparatus as claimed in claim 32, wherein said press roller has a diameter ranging from 16 mm to 60 mm.

35. The apparatus as claimed in claim 31, further comprising a cleaning backup roller for nipping said belt member in cooperation with said press roller, and in that said drive means is configured to rotate at least said cleaning backup roller.

36. The apparatus as claimed in claim 31, wherein said press roller has a diameter ranging from 16 mm to 60 mm.

37. The apparatus as claimed in claim 36, wherein said press roller has a diameter ranging from 16 mm to 60 mm.

38. The apparatus as claimed in claim 31, wherein the plurality of support members each have a diameter ranging from 16 mm to 30 mm.

39. The apparatus as claimed in claim 30, wherein the plurality of support rollers each have a diameter ranging from 16 mm to 30 mm.

40. In an image forming apparatus including an image carrier for carrying a toner image and image transferring means for transferring said toner image from said image carrier to either one of an endless belt member and a recording medium held on a surface of said endless belt member, said image transferring means comprising:

a belt device comprising an endless belt member and a plurality of support members supporting said endless belt member at an inside of said belt member;

drive means for rotating at least one of said support members to thereby cause said belt member to move; and image transferring means for transferring a toner image formed on an image carrier, which faces an outside surface of said belt member, from said image carrier to said belt member or a recording medium held on a surface of said belt member;

said belt member comprising:

a rib formed on an endless inside surface thereof and extending in a circumferential direction of said belt member for protecting said belt member from deviation; and a plurality of bores formed in said rib at intervals in the circumferential direction, each bore extending in a widthwise direction of the belt member.

41. In an image forming apparatus including an image carrier for carrying a toner image and a duplex image transferring device for transferring visible images from said image carrier to opposite sides of a recording medium, said duplex image transferring device comprising:

a first image transferring device comprising:

a first belt device comprising a first endless belt member and a first plurality of support members supporting said first endless belt member at an inside of said first belt member;

drive means for rotating at least one of said first support members to thereby cause said first belt member to move; and image transferring means for transferring a toner image formed on an image carrier, which faces an outside surface of said first belt member, from said image carrier to said first belt member or a recording medium held on a surface of said first belt member;

a second image transferring device comprising:

a second belt device comprising a second endless belt member and a second plurality of support members supporting said second endless belt member at an inside of said second belt member;

drive means for rotating at least one of said second support members to thereby cause said second belt member to move; and image transferring means for transferring a toner image carried on an outside surface of said second belt member to a recording medium contacting said outside surface of said second belt member;

said first or second belt member comprising:

a rib formed on an endless inside surface thereof and extending in a circumferential direction of said first or second belt member for protecting said first or second belt member from deviation;

a plurality of cuts formed in said rib at intervals in the circumferential direction and each extending from a top toward a bottom of said rib; and a plurality of through bores formed in said rib at intervals in the circumferential direction of said belt member and each extending in a widthwise direction of said belt member, said plurality of through bores each being contiguous with a respective one of said plurality of cuts;

wherein a toner image is transferred from said first belt member of said first image transferring device to one surface of a recording medium while a toner image is transferred from said second belt member of said second image transferring device to the other surface of said recording medium.

42. The apparatus as claimed in claim 41, wherein said first belt device comprises a press roller pressing an outside surface of said first belt member to thereby inversely bend said first belt member toward an inside of a belt loop.

43. The apparatus as claimed in claim 42, wherein said press roller comprises a center portion and end portions positioned at opposite ends of said center portion in an axial direction and projecting radially outward from said center portion, and in that said center portion presses the outside surface of said first belt member.

44. The apparatus as claimed in claim 43, wherein said center portion and said end portions are formed separately from each other.

45. The apparatus as claimed in claim 41, wherein the plurality of support members each have a diameter ranging from 16 mm to 30 mm.

46. In an image forming apparatus including an image carrier for carrying a toner image and a duplex image transferring device for transferring visible images from said image carrier to opposite sides of a recording medium, said duplex image transferring device comprising:

a first image transferring device comprising:

a first belt device comprising a first endless belt member and a first plurality of support members supporting said first endless belt member at an inside of said first belt member;

drive means for rotating at least one of said first support members to thereby cause said first belt member to move; and image transferring means for transferring a toner image formed on an image carrier, which faces an outside surface of said first belt member, from said image carrier to said first belt member or a recording medium held on a surface of said first belt member;

a second image transferring device comprising:

a second belt device comprising a second endless belt member and a second plurality of support members supporting said second endless belt member at an inside of said second belt member;

drive means for rotating at least one of said second support members to thereby cause said second belt member to move; and image transferring means for transferring a toner image carried on an outside surface of said second belt member to a recording medium contacting said outside surface of said second belt member;

said first or second belt member comprising:

a rib formed on an endless inside surface thereof and extending in a circumferential direction of said first or second belt member for protecting said first or second belt member from deviation; and a plurality of bores formed in said rib at intervals in the circumferential directions, each bore extending in a widthwise direction of the belt member;

wherein a toner image is transferred from said first belt member of said first image transferring device to one surface of a recording medium while a toner image is transferred from said second belt member of said second image transferring device to the other surface of said recording medium.

* * * * *